US012808376B2

(12) United States Patent
Calhoun

(10) Patent No.: US 12,808,376 B2
(45) Date of Patent: Nov. 24, 2026

(54) SCROLL PUMP WITH TWO-PIECE CRANKSHAFT

(71) Applicant: Agilent Technologies, Inc., Santa Clara, CA (US)

(72) Inventor: John Calhoun, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 194 days.

(21) Appl. No.: 18/525,190

(22) Filed: Nov. 30, 2023

(65) Prior Publication Data

US 2025/0180022 A1 Jun. 5, 2025

(51) Int. Cl.

| | |
|---|---|
| ***F04C 29/00*** | (2006.01) |
| ***F04C 2/07*** | (2006.01) |
| ***F04C 14/22*** | (2006.01) |
| ***F04C 15/00*** | (2006.01) |
| ***F04C 18/02*** | (2006.01) |
| ***F04C 23/00*** | (2006.01) |

(52) U.S. Cl.

CPC ..... *F04C 29/005* (2013.01); *F04C 18/0215* (2013.01); *F04C 2/07* (2013.01); *F04C 14/22* (2013.01); *F04C 15/0065* (2013.01); *F04C 23/008* (2013.01); *F04C 2230/85* (2013.01)

(58) Field of Classification Search

CPC .. F04C 18/0215; F04C 23/001; F04C 23/008; F04C 29/0042; F04C 29/005; F04C 29/0057; F04C 29/0078; F04C 2230/85; F04C 2240/601; F04C 2/07; F04C 2/101; F04C 2/103; F04C 2/16; F04C 14/22; F04C 15/0065; F04C 18/02; F04C 18/0207; F04C 29/00; F04C 29/0071; F04C 2230/60; F04C 2230/80; F04C 2240/30; F16D 1/06; F16D 1/02; F16B 7/182

See application file for complete search history.

(56) References Cited

U.S. PATENT DOCUMENTS

| | | | | |
|---|---|---|---|---|
| 826,944 | A * | 7/1906 | Krieger | F16D 1/092 403/333 |
| 3,881,234 | A * | 5/1975 | Crowell | G03D 3/13 492/15 |
| 4,199,308 | A | 4/1980 | Mccullough | |
| 5,759,020 | A | 6/1998 | Shaffer | |
| 5,855,473 | A | 1/1999 | Liepert | |
| 6,129,530 | A | 10/2000 | Shaffer | |

(Continued)

OTHER PUBLICATIONS

TriScroll 600 Inverter Dry Scroll Vacuum Pump manual; Agilent Technologies, Inc.; 2014; 34 pages.

(Continued)

*Primary Examiner* — Binh Q Tran

(57) ABSTRACT

In a pump head for a scroll pump, an orbiting scroll is coupled to a crank of a crankshaft. As the crankshaft rotates, the crank drives the orbiting scroll to orbit relative to one or more fixed scrolls to pump fluid from an inlet to an outlet. A stub shaft is attached to the crank and may be removed as part of an at least partial disassembly of the pump head. An adjusting nut may adjust an axial position of the orbiting scroll relative to the fixed scroll(s). The adjusting nut may be removed, and thereafter reinstalled, together with the stub shaft without altering an axial position of the adjusting nut relative to the stub shaft.

20 Claims, 10 Drawing Sheets

(56) References Cited

U.S. PATENT DOCUMENTS

| | | | | |
|---|---|---|---|---|
| 6,511,308 | B2 | 1/2003 | Shaffer | |
| 7,357,627 | B2 | 4/2008 | Sato | |
| 8,177,534 | B2 | 5/2012 | Ni | |
| 8,591,210 | B2 | 11/2013 | Collie | |
| 8,961,160 | B2 | 2/2015 | Calhoun | |
| 9,328,730 | B2 | 5/2016 | Calhoun et al. | |
| 9,366,255 | B2 | 6/2016 | Forni | |
| 10,161,399 | B2 | 12/2018 | Schofield | |
| 10,947,974 | B2 | 3/2021 | Schofield | |
| 2006/0078450 | A1 | 4/2006 | Liepert et al. | |
| 2015/0152866 | A1* | 6/2015 | Forni | F04C 18/0215 418/55.1 |
| 2022/0299027 | A1 | 9/2022 | Holbrook et al. | |

OTHER PUBLICATIONS

TriScroll 600 Series Dry Scroll Vacuum Pump Major Maintenance Manual; Agilent Technologies, Inc.; 2015; 100 pages.
UK Intellectual Property Office Search Report under Section 17(5) dated Apr. 8, 2025 for application No. GB2417083.9; 3 pages.

* cited by examiner

SCROLL PUMP WITH TWO-PIECE CRANKSHAFT

TECHNICAL FIELD

The present invention relates to scroll pumps, and particularly to configurations of a crankshaft utilized in scroll pumps.

BACKGROUND

Scroll pumps are widely utilized as compressors for supplying a pressurized working fluid (e.g., compressed air) and as vacuum pumps for evacuating a chamber by removing a working fluid from the chamber. As appreciated by the skill artisan, a scroll pump has at least one pumping (or compression) stage formed by an orbiting scroll and a fixed (stationary) scroll. The orbiting scroll has an orbiting scroll blade extending in an axial direction from a radially oriented orbiting scroll plate (or base) toward the fixed scroll. The fixed scroll has a fixed scroll blade extending in the opposite axial direction from a radially oriented fixed scroll plate (or base) toward the orbiting scroll. The scroll blades (or "wraps") are spiral-shaped. That is, each scroll blade runs along a spiral path in multiple revolutions around the central region of its corresponding scroll plate. The orbiting and fixed scroll blades are nested with each other. The scroll pump further has a motor-driven crankshaft that rotates about its central shaft axis, or drive axis. The crankshaft has an eccentrically positioned crank located at the end of the crankshaft that is opposite to the motor. The central axis of the crank is radially offset from the drive axis of the main part of the crankshaft. Thus, as the main part of the crankshaft rotates about the drive axis, the crank orbits in a circle (whose radius corresponds to the radial offset distance) around the drive axis. The orbiting scroll is coupled to the crank and thus orbits with the crank, but without the orbiting scroll itself rotating on its own axis.

In operation, the orbiting scroll is driven by the crankshaft to orbit around the drive axis relative to the fixed scroll to create one or more moving, variable-volume pumping chambers or zones, also referred to as "pockets", between the orbiting scroll blade and the fixed scroll blade. Each pocket is defined between and bounded by adjacent sections of the orbiting scroll blade and the fixed scroll blade. As the orbiting scroll orbits, the pockets receive the (typically gas-phase) working fluid from a pump inlet and displace (transport) the working fluid to a pump outlet. As the pockets move in accordance with the orbiting motion, the volume of the space inside the pockets decreases, thereby compressing the working fluid to some degree as the working fluid is being displaced toward the pump outlet.

An example of the structure and operation of such a scroll pump is described in U.S. Pat. No. 5,855,473, the entire contents of which are incorporated by reference herein.

A scroll pump may have more than one pumping stage, such as two pumping stages fluidly connected in series. For example, the orbiting scroll may be positioned between two fixed scrolls, namely, a fixed outboard scroll having a fixed outboard scroll blade and a fixed inboard scroll having a fixed inboard scroll blade. In this case, the orbiting scroll has one orbiting scroll blade on its inboard side and another orbiting scroll blade on its outboard side. The orbiting outboard scroll blade is nested with the fixed outboard scroll blade to cooperatively define one (outboard) pumping stage, and the orbiting inboard scroll blade is nested with the fixed inboard scroll blade to cooperatively define another (inboard) pumping stage, In operation, the first pumping stage (either the outboard stage or the inboard stage, depending on configuration) receives the working fluid from the pump inlet, compresses the working fluid, and transfers the compressed working fluid to the second pumping stage. The second pumping stage further compresses the working fluid and discharges the further compressed working fluid toward the pump outlet. An example of such a two-stage scroll pump is described in above-referenced U.S. Pat. No. 5,855,473.

In either a single-stage or multi-stage scroll pump, the orbiting scroll and the fixed scroll(s) do not contact each other. Instead, small axial gaps exist between the blade tips (free ends) of each scroll blade and the surfaces of the scroll plates that are immediately axially adjacent to and facing those corresponding blade tips. For example, on a given (outboard or inboard) side of the orbiting scroll plate, the blade tip of the orbiting scroll blade is spaced from the surface of the fixed scroll plate by an axial gap. Likewise, on the same side, the blade tip of the fixed scroll blade is spaced from the surface of the orbiting scroll plate by an axial gap. The axial gaps are necessary so that the orbiting scroll may move with respect to the fixed scroll(s). The scroll pump may be a "dry" scroll pump, meaning that it is not sealed or lubricated by a liquid such as oil. In this case, the axial gaps are closed and sealed by tip seals mounted to the respective blade tips, such that each tip seal runs continuously along the same spiral path as its corresponding scroll blade. The tip seals enhance the sealing interfaces between the orbiting scroll and the fixed scroll(s) without impairing the motion of the orbiting scroll. The tip seals wear down with pump operation over time and thus eventually need to be replaced with new tip seals.

The size (axial dimension) of the axial gaps is determined by the axial position of the orbiting scroll relative to the fixed scroll(s). In many cases, it is important to control the axial relation between the orbiting scroll and the fixed scroll(s). Various means for axial adjustment have been utilized for this purpose. As one example (see FIGS. 2 and 3 of above-referenced U.S. Pat. No. 5,855,473), the axial position of the orbiting scroll may be controlled (adjusted) by an adjusting nut that is threaded onto the crank of the crankshaft. Rotation of the adjusting nut adjusts its axial position (translates the adjusting nut) along the length of the crank. The adjusting nut is interfaced with the orbiting scroll such that the adjusting nut can be utilized to adjust (set) the axial position of the orbiting scroll relative to the fixed scroll(s) and consequently the size of the axial gaps. Once the correct axial position is established, the adjusting nut is secured in place by tightening four locking screws.

As noted above, the tip seals on the scroll blades need to be replaced periodically. To gain access to the tip seals, the pump head needs to be partially disassembled and, after installing new tip seals, reassembled. For scroll pumps having an inboard pumping stage, disassembly includes removal of the orbiting scroll to gain access to the inboard side of the orbiting scroll and to the fixed inboard scroll. Disadvantageously, it may be necessary to remove the adjusting nut to be able to remove the orbiting scroll and gain access to all of the tip seals. Once the adjusting nut is removed and thereafter remounted to the crank, careful measurements must be taken (e.g., by using a depth gauge) to precisely relocate the adjusting nut in the correct axial position and thereby reestablish the correct setting of the axial position of the orbiting scroll relative to the fixed scroll(s). This task takes considerable time and is prone to errors (e.g., inaccuracy, imprecision, etc.), especially if the person doing the maintenance is not highly trained. Such errors rarely occur in the factory where the scroll pump is built, because the factory has special jigs and fixtures as well as personnel experienced and trained in the process of properly and accurately setting the adjusting nut when the scroll pump is first assembled.

In view of the foregoing, there is a need for further solutions regarding the maintenance of scroll pumps.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a scroll pump (e.g., a scroll pump assembly, or at least a scroll pump head thereof) includes: a pumping stage comprising an orbiting scroll and a fixed scroll nested together, wherein the orbiting scroll is configured to orbit about a drive axis relative to the fixed scroll to create a moving pocket between the orbiting scroll and the fixed scroll effective to pump fluid from a pump inlet to a pump outlet; a crankshaft comprising a main shaft rotatable about the drive axis and a crank radially offset from the drive axis and coupled to the orbiting scroll, wherein the crank is configured to drive the orbiting scroll to orbit around the drive axis in response to rotation of the main shaft; and a stub shaft removably attached to the crank.

According to another implementation, a method for performing maintenance on a scroll pump (e.g., a scroll pump assembly, or at least a scroll pump head thereof) includes: providing a scroll pump according to any of the implementations described herein; removing the stub shaft from the crank; and removing the orbiting scroll from the crank.

According to another implementation, a method for performing maintenance on a scroll pump (e.g., a scroll pump assembly, or at least a scroll pump head thereof) includes: providing the scroll pump head, the scroll pump head including: a pumping stage comprising an orbiting scroll and a fixed scroll nested together, wherein the orbiting scroll is configured to orbit about a drive axis relative to the fixed scroll to create a moving pocket between the orbiting scroll and the fixed scroll effective to pump fluid from a pump inlet to a pump outlet; a crankshaft comprising a main shaft rotatable about the drive axis and a crank radially offset from the drive axis and coupled to the orbiting scroll, wherein the crank is configured to drive the orbiting scroll to orbit around the drive axis in response to rotation of the main shaft; and a stub shaft removably attached to the crank. The method further includes: removing the stub shaft from the crank; and removing the orbiting scroll from the crank.

Additional implementations of the scroll pump and/or the method will now be summarized.

In an implementation, the orbiting scroll comprises an orbiting scroll bore, and the stub shaft is disposed in the orbiting scroll bore when removably attached to the crank.

In an implementation, the scroll pump includes a stub shaft fastener configured to removably attach the stub shaft to the crank. The stub shaft fastener may be separate from or integral with the stub shaft. In one implementation, the crank comprises a crank axial bore with an inner thread, and the stub shaft fastener comprises a stub shaft screw with an outer thread configured to engage the inner thread. The stub shaft screw. may be separate from or integral with the stub shaft.

In an implementation, the crank includes a crank end adjacent to the stub shaft and a relief disposed at the crank end, and the relief has an outside diameter that is reduced in comparison to an outside diameter of a remaining portion of the crank. In one implementation, the scroll pump includes an annular member (e.g., a bearing, spacer, etc.) surrounding the crank such that a radial gap is defined between the crank and the annular member, wherein the radial gap comprises an enlarged radial gap section defined between the relief and the annular member, and the enlarged radial gap section is larger than a remaining portion of the radial gap.

In an implementation: the orbiting scroll has an outboard side and an inboard side, and along an axial direction relative to the drive axis, the outboard side is closer to an ambient external to the scroll pump head than the inboard side; the fixed scroll is a fixed inboard scroll, the pumping stage is an inboard pumping stage comprising the fixed inboard scroll and the inboard side of the orbiting scroll, and the orbiting scroll and the fixed inboard scroll are nested together on the inboard side; and the outboard side blocks access to the inboard side and the fixed inboard scroll in a direction from the outboard side toward the inboard side.

In an implementation, the orbiting scroll comprises an orbiting inboard tip seal, the fixed inboard scroll comprises a fixed inboard tip seal, and the outboard side blocks access to the orbiting inboard tip seal and the fixed inboard tip seal in the direction from the outboard side toward the inboard side.

In an implementation, the scroll pump includes an outboard pumping stage, which includes a fixed outboard scroll and the outboard side of the orbiting scroll, wherein: the orbiting scroll and the fixed outboard scroll are nested together on the outboard side; and the orbiting scroll is configured to orbit about the drive axis relative to the fixed outboard scroll to create a moving pocket on the outboard side between the orbiting scroll and the fixed outboard scroll.

In an implementation: the orbiting scroll comprises an orbiting inboard tip seal and an orbiting outboard tip seal, the fixed inboard scroll comprises a fixed inboard tip seal, and the fixed outboard scroll comprises a fixed outboard tip seal; and the outboard side blocks access to the orbiting inboard tip seal and the fixed inboard tip seal in the direction from the outboard side toward the inboard side.

In an implementation: the orbiting scroll has an outboard side and an inboard side, and along an axial direction relative to the drive axis, the outboard side is closer to an ambient external to the scroll pump head than the inboard side; the fixed scroll is a fixed inboard scroll, and the pumping stage is an inboard pumping stage comprising the fixed inboard scroll and the inboard side of the orbiting scroll; the orbiting scroll comprises an orbiting scroll plate oriented in a transverse plane orthogonal to the drive axis and an orbiting inboard scroll blade; the fixed inboard scroll comprises a fixed inboard scroll plate oriented in the transverse plane and a fixed inboard scroll blade; the orbiting inboard scroll blade extends from the orbiting scroll plate in the axial direction toward the fixed inboard scroll plate; the fixed inboard scroll blade extends from the fixed inboard scroll plate in the axial direction toward the orbiting scroll plate and is nested with the orbiting inboard scroll blade; and the orbiting inboard scroll blade and the fixed inboard scroll blade are disposed on the inboard side, such that the outboard side blocks access to the orbiting inboard scroll blade and the fixed inboard scroll blade.

In an implementation, the orbiting scroll comprises an orbiting tip seal mounted to the orbiting inboard scroll blade at an axial gap between the orbiting inboard scroll blade and the fixed inboard scroll plate, the fixed inboard scroll comprises a fixed tip seal mounted to the fixed inboard scroll blade at an axial gap between the fixed inboard scroll blade and the orbiting scroll plate, and the outboard side blocks access to the orbiting tip seal and the fixed tip seal.

In an implementation, the scroll pump head further includes an outboard pumping stage comprising a fixed outboard scroll and the outboard side of the orbiting scroll, wherein: the orbiting scroll is configured to orbit about the drive axis relative to the fixed outboard scroll in addition to the fixed inboard scroll to create a moving pocket between the orbiting scroll and the fixed outboard scroll; the orbiting scroll comprises an orbiting outboard scroll blade; the fixed outboard scroll comprises a fixed outboard scroll plate oriented in the transverse plane and a fixed outboard scroll blade; the orbiting outboard scroll blade extends from the orbiting scroll plate in the axial direction toward the fixed outboard scroll plate; the fixed outboard scroll blade extends from the fixed outboard scroll plate in the axial direction toward the orbiting scroll plate and is nested with the orbiting outboard scroll blade; and the orbiting outboard scroll blade and the fixed outboard scroll blade are disposed on the outboard side.

In an implementation: the orbiting scroll comprises an orbiting inboard tip seal mounted to the orbiting inboard scroll blade at an axial gap between the orbiting inboard scroll blade and the fixed inboard scroll plate, and an orbiting outboard tip seal mounted to the orbiting outboard scroll blade at an axial gap between the orbiting outboard scroll blade and the fixed outboard scroll plate; the fixed inboard scroll comprises a fixed inboard tip seal mounted to the fixed inboard scroll blade at an axial gap between the fixed inboard scroll blade and the orbiting scroll plate; the fixed outboard scroll comprises a fixed outboard tip seal mounted to the fixed outboard scroll blade at an axial gap between the fixed outboard scroll blade and the orbiting scroll plate; and the outboard side blocks access to the orbiting inboard tip seal and the fixed inboard tip seal.

In an implementation, the scroll pump includes an adjusting nut axially adjustable relative to the stub shaft, wherein the adjusting nut is configured to contact a surface coupled to or integral with the orbiting scroll, and axial adjustment of the adjusting nut adjusts an axial position of the orbiting scroll relative to the fixed scroll.

In an implementation, the adjusting nut is engaged with the stub shaft at a preset axial position on the stub shaft, and the adjusting nut and the stub shaft are removable from and reinstallable to the crank together as an assembly without altering the preset axial position.

In an implementation, the adjusting nut comprises an adjusting nut thread, and the stub shaft comprises a stub shaft thread configured to engage the adjusting nut thread.

In an implementation, the adjusting nut is located at a position that prevents removal of the orbiting scroll from the crank.

In an implementation, the removing of the orbiting scroll comprises removing the entire orbiting scroll as a single-piece component.

In an implementation, the stub shaft is removably attached to the crank by a fastener, and the removing of the stub shaft comprises operating the fastener to unfasten the stub shaft from the crank. In one implementation, the removing of the stub shaft comprises unscrewing the stub shaft from the crank.

In an implementation: before the removing of the orbiting scroll, the orbiting scroll blocks access to an inboard component of the scroll pump head; and the method further includes, after the removing of the orbiting scroll, servicing or replacing the inboard component. In one implementation, the inboard component is at least one of an orbiting scroll blade of the orbiting scroll or a fixed scroll blade of the fixed scroll.

In an implementation: the orbiting scroll comprises an orbiting tip seal, and the fixed scroll comprises a fixed tip seal; before the removing of the orbiting scroll, the orbiting scroll blocks access to the orbiting tip seal and the fixed tip seal; and the method further comprises, after the removing of the orbiting scroll, replacing at least one of the orbiting tip seal or the fixed tip seal with a new tip seal.

In an implementation: the orbiting scroll has an outboard side and an inboard side, and along an axial direction relative to the drive axis, the outboard side is closer to an ambient external to the scroll pump head than the inboard side; the fixed scroll is a fixed inboard scroll, the pumping stage is an inboard pumping stage comprising the fixed inboard scroll and the inboard side of the orbiting scroll, and the orbiting scroll and the fixed inboard scroll are nested together on the inboard side; and before the removing of the orbiting scroll, the outboard side blocks access to the inboard side and the fixed inboard scroll in a direction from the outboard side toward the inboard side.

In an implementation: the orbiting scroll comprises an orbiting tip seal; the fixed inboard scroll comprises a fixed tip seal; before the removing of the orbiting scroll, the outboard side blocks access to the orbiting tip seal and the fixed tip seal in the direction from the outboard side toward the inboard side; and the method further comprises, after the removing of the orbiting scroll, replacing at least one of the orbiting tip seal or the fixed tip seal with a new tip seal.

In an implementation: the scroll pump head comprises an outboard pumping stage, the outboard pumping stage comprising a fixed outboard scroll and the outboard side of the orbiting scroll; the orbiting scroll and the fixed outboard scroll are nested together on the outboard side; and the orbiting scroll is configured to orbit about the drive axis relative to the fixed outboard scroll to create a moving pocket on the outboard side between the orbiting scroll and the fixed outboard scroll.

In an implementation: the orbiting scroll comprises an orbiting inboard tip seal and an orbiting outboard tip seal, the fixed inboard scroll comprises a fixed inboard tip seal, and the fixed outboard scroll comprises a fixed outboard tip seal; before the removing of the orbiting scroll, the outboard side blocks access to the orbiting inboard tip seal and the fixed inboard tip seal in the direction from the outboard side toward the inboard side; and the method further comprises, after the removing of the orbiting scroll, replacing at least one of the orbiting inboard tip seal or the fixed inboard tip seal with a new tip seal.

In an implementation, the method includes, before the removing of the orbiting scroll, removing the fixed outboard scroll.

In an implementation, the scroll pump head comprises an adjusting nut axially adjustable relative to the stub shaft and, before the removing of the stub shaft, the adjusting nut is located at a preset axial position relative to the stub shaft. In one implementation, the removing of the stub shaft comprises removing the adjusting nut together with the stub shaft as an assembly without altering the preset axial position. In one implementation, after the removing of the adjusting nut together with the stub shaft, the method includes reinstalling the adjusting nut together with the stub shaft by reattaching the stub shaft to the crank, wherein the preset axial position of the adjusting nut on the stub shaft determines an axial position of the orbiting scroll relative to the fixed scroll, and the reattaching restores the axial position of the orbiting scroll relative to the fixed scroll corresponding to the preset axial position.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

Figure 1:
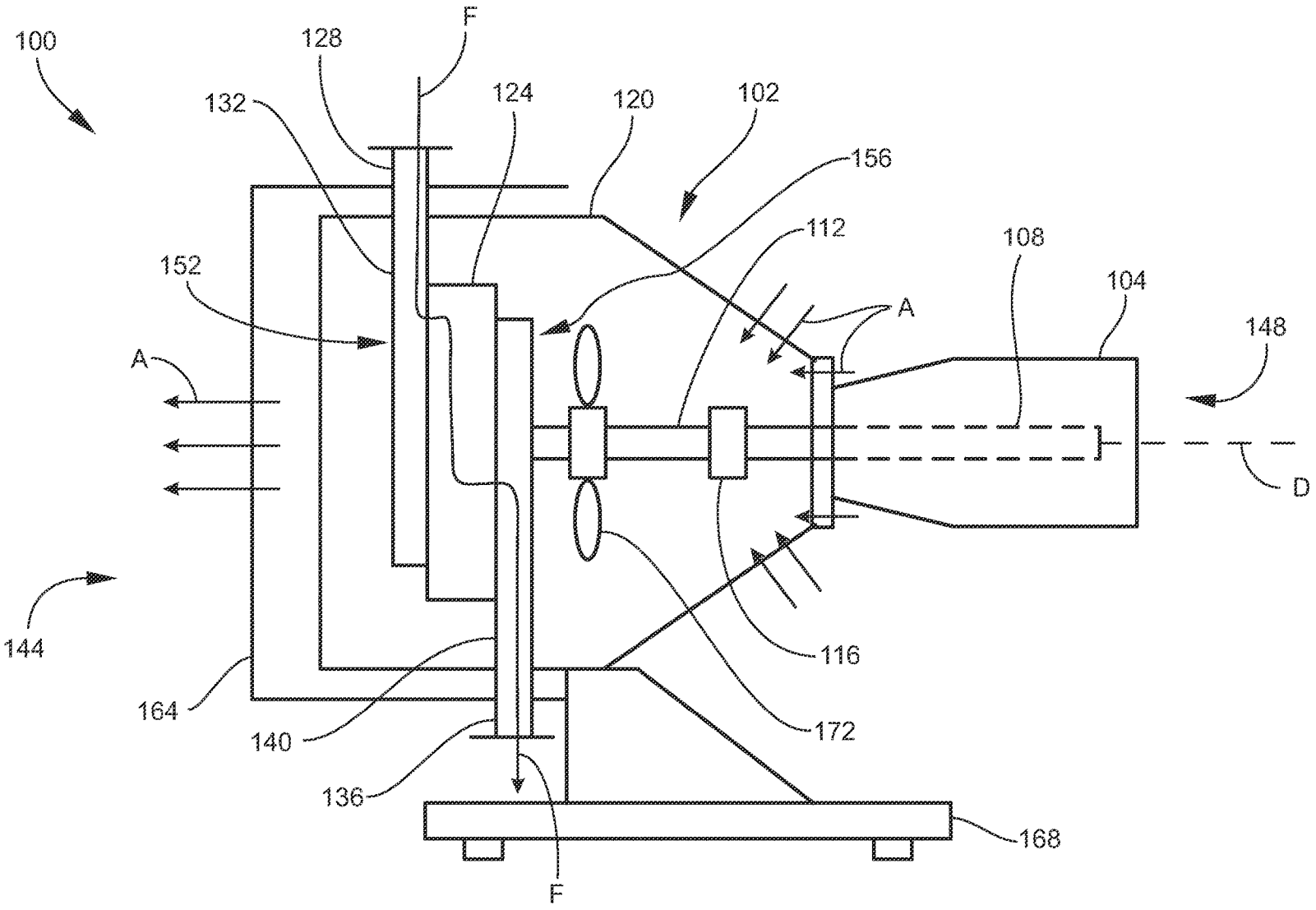
FIG. 1 is a cross-sectional elevation view of an example of a scroll pump (assembly) in which the subject matter disclosed herein may be implemented.

The illustrations in all of the drawing figures are considered to be schematic, unless specifically indicated otherwise.

DETAILED DESCRIPTION

In this disclosure, all "implementations," "aspects," "examples," and "embodiments" described are considered to be non-limiting and non-exclusive. Accordingly, the fact that a specific "implementation," "aspect," "example," or "embodiment" is explicitly described herein does not exclude other "implementations," "aspects," "examples," and "embodiments" from the scope of the present disclosure even if not explicitly described. In this disclosure, the terms "implementations," "aspect," "example," and "embodiment" are used interchangeably, i.e., are considered to have interchangeable meanings.

In this disclosure, the term "substantially," "approximately," or "about," when modifying a specified numerical value, may be taken to encompass a range of values that include +/−10% of such numerical value, unless specifically indicated otherwise.

FIG. 1 is a cross-sectional elevation view of an example of a scroll pump (assembly) 100 in which the subject matter disclosed herein may be implemented. The scroll pump 100 may be configured for use as a vacuum pump or as a compressor, as appreciated by persons skilled in the art. The type of working fluid pumped by the scroll pump 100 depends on the application for which the scroll pump 100 is utilized. The working fluid is often a gas (or mixture of gases) such as, for example, air, oxygen, nitrogen, a noble gas (e.g., helium, argon, etc.), a gas-phase compound (e.g., carbon dioxide, a refrigerant, etc.), a gas utilized in a chemical, manufacturing, or analytical process, etc. Alternatively, the working fluid may be a liquid. The structure and operation of scroll pumps are generally understood by persons skilled in the art, and thus the scroll pump 100 and certain components thereof are described only briefly herein to provide a context for the presently disclosed subject matter.

The scroll pump 100 includes a pump head 102 powered by a motor 104. Typically, the motor 104 is an electric motor that includes a motor rotor (not shown) driven to rotate relative to a motor stator (not shown) by a magnetic field established between the motor rotor and motor stator by permanent magnets and/or electromagnets provided with the motor rotor and motor stator, as appreciated by persons skilled in the art. The motor rotor is coupled to a motor (output) shaft 108 that thus rotates with the motor rotor. The motor shaft 108 is coupled to a crankshaft 112 by an appropriate shaft coupling 116 such that the crankshaft 112 is driven to rotate by the motor rotor via the motor shaft 108 and shaft coupling 116. The shaft coupling 116 may be a mechanical coupling (e.g., shaft joint, spider coupling, etc.) or a non-contact type of coupling such as an axially- or radially-oriented magnetic coupling, as appreciated by persons skilled in the art. Alternatively, the pump head 102 and motor 104 are directly coupled by a single drive shaft instead of utilizing a separate motor shaft 108, crankshaft 112 and intermediate shaft coupling 116. The motor shaft 108 and at least a main portion of the crankshaft 112 rotate concentrically or coincidently about a central drive axis D.

The pump head 102 includes a pump frame 120, which may be a single-part construction or a multi-part construction in which two or more separate frame parts may be assembled to each other and disassembled from each other. The pump frame 120 may be configured to serve as a pump housing that encloses various components of the pump head 102, and/or as a structural support to which various components are attached or with which various components are integral. The pump head 102 further includes one or more pumping elements configured to define one or more pumping (or compression) stages 124. At least one of the pumping elements is coupled to and driven to move by the crankshaft 112. In the implementations described herein, the pumping elements are scrolls as described in more detail below. The pump head 102 further includes a pump inlet 128 and an inlet conduit 132 (e.g., one or more passages, pipes, tubes, chambers, manifolds, plenums, headers, etc.) configured to direct a flow of incoming (aspirated) working fluid (the fluid being pumped) from the pump inlet 128 to the pumping stage(s) 124. The pump head 102 further includes a pump outlet 136 and an outlet conduit 140 (e.g., one or more passages, pipes, tubes, chambers, manifolds, plenums, headers, etc.) configured to direct a flow of outgoing (discharged) working fluid from the pumping stage(s) 124 to the pump outlet 136. Accordingly, the pump head 102 (particularly the pumping stage(s) 124) is configured to transport (or displace by pumping action) the working fluid from the pump inlet 128, through the inlet conduit 132, through the pumping stage(s) 124 and through the outlet conduit 140, and to the pump outlet 136, as indicated by an arrow F in FIG. 1. The inlet side of the pumping stage(s) 124 is the low-pressure (or vacuum) side and the outlet side of the pumping stage(s) 124 is the high-pressure side. The pump inlet 128 and/or the pump outlet 136 may include fittings as needed for fluidly connecting the pump head 102 to components (e.g., conduits, chambers, etc.) external to the scroll pump 100.

For purposes of reference and description, terms such as "axial" and "axially" are taken relative to the drive axis D. The drive axis D may be extended in either direction and considered to be part of (or coincident with) an overall longitudinal pump axis of the scroll pump 100. For example, an "axial distance" between any two components of the scroll pump 100 is a distance measurable along the (extended) drive axis D in either direction (from left to right, or right to left, from the perspective of FIG. 1). The drive axis D/pump axis is horizontal from the perspective of FIG. 1. In addition, terms such as "radial" and "transverse" refer to directions orthogonal to the axis D/pump axis, including the vertical direction from the perspective of FIG. 1. In addition, the scroll pump 100 is considered to have a front side 144 and a rear side 148. From the perspective of FIG. 1, the front side 144 corresponds to the left side and the rear side 148 corresponds to the right side of the scroll pump 100. Along the axial direction, the pump head 102 is nearer to the front side 144 than the motor 104, and the motor 104 is nearer to the rear side 148 than the pump head 102. Further, the pump head 102 is considered to have an outboard side 152 and an inboard side 156. Along the axial direction, the outboard side 152 is nearer to the front side 144 than the inboard side 156, and the inboard side 156 is nearer to the motor 104 than the outboard side 152. Along the axial direction, the outboard side 152 is nearer to the ambient (the space or environment external to the scroll pump 100) than the inboard side 156. In other words, the inboard side 156 is located farther into the interior of the pump head 102 than the outboard side 152. Correspondingly, any of the individual components (e.g., the pumping stage 124) of the pump head 102 likewise may be considered to have an outboard side and an inboard side.

The scroll pump 100 may further include an outer cowling 164 that covers all or a portion of the pump head 102. The cowling 164 may be a single-piece structure or may have two or more distinct sections attachable to and detachable from each other. For example, one section of the cowling 164 may enclose all or part of the pump head 102 while another section encloses all or part of the motor 104. Alternatively, the motor 104 may be enclosed in a motor housing (not shown) distinct from the cowling 164. The cowling 164 and/or motor housing may enclose electrical components external to the motor 104 (e.g., circuitry, wiring/cables, electrical interconnects, other electrical hardware, etc.). The cowling 164 may be composed of a plastic or metallic material. The cowling 164 may provide additional functions such as preventing a user from touching hot surfaces of the scroll pump 100, defining one or more flow paths around and/or through the pump head 102 or additionally the motor 104 for cooling air, etc. The cowling 164 may be attached to a tray (not shown) that covers the underside of the pump head 102 or additionally the motor 104. The scroll pump 100 may further include a suitable base or platform 168 configured to support the weight of the scroll pump 100 in a stable manner as the scroll pump 100 rests on or is mounted to an underlying surface such as a floor, table, bench, etc. The base 168 or other component(s) may be configured to dampen vibrations generated by the scroll pump 100 during operation.

The scroll pump 100 may further include one or more cooling fans 172 for directing cooling air into thermal contact with the pump head 102 or additionally the motor 104 to carry dissipated heat away from the scroll pump 100. In the present implementation, a cooling fan 172 is positioned in the pump frame 120 axially between the inboard side of the pumping stage(s) 124 and the motor 104. In this case, the cooling fan 172 may be mounted to and thereby powered by the crankshaft 112 as illustrated. The cooling fan 172 may draw in ambient air from, for example, the rear or outboard side of the pump head 102, such as though one or more openings (vents) formed in the pump frame 120, direct the drawn in ambient air along one or more air flow paths through the interior of the pump frame 120 (including around and in thermal contact with the pumping stage(s) 124), and discharge the now heat-laden ambient air out from one or more openings (vents) formed in the cowling 164 at the front or inboard side of the pump head 102. FIG. 1 depicts an example of a few air flow paths by arrows A. Alternatively or additionally, the cowling 164 may enclose the motor 104 or be attached to a separate motor housing, so that the air flow paths extend around and in thermal contact with the motor 104 and the ambient air enters and/or is discharged from the motor housing. Alternatively or additionally, a cooling fan may be located at or near the front side 144 of the scroll pump 100, such as in an interior space of the cowling 164 adjacent to the outboard side of the pump head 102. In such configuration, the cooling fan may be powered by its own (electric) motor. Alternatively or additionally, if the motor 104 is enclosed by an extended version of the cowling 164 or by a separate motor housing, a cooling fan may be located in the enclosed interior space surrounding the motor 104 to directly cool the motor 104 and associated electrical hardware (e.g., circuit board(s), wiring harness(es), etc.).

Figure 2A:
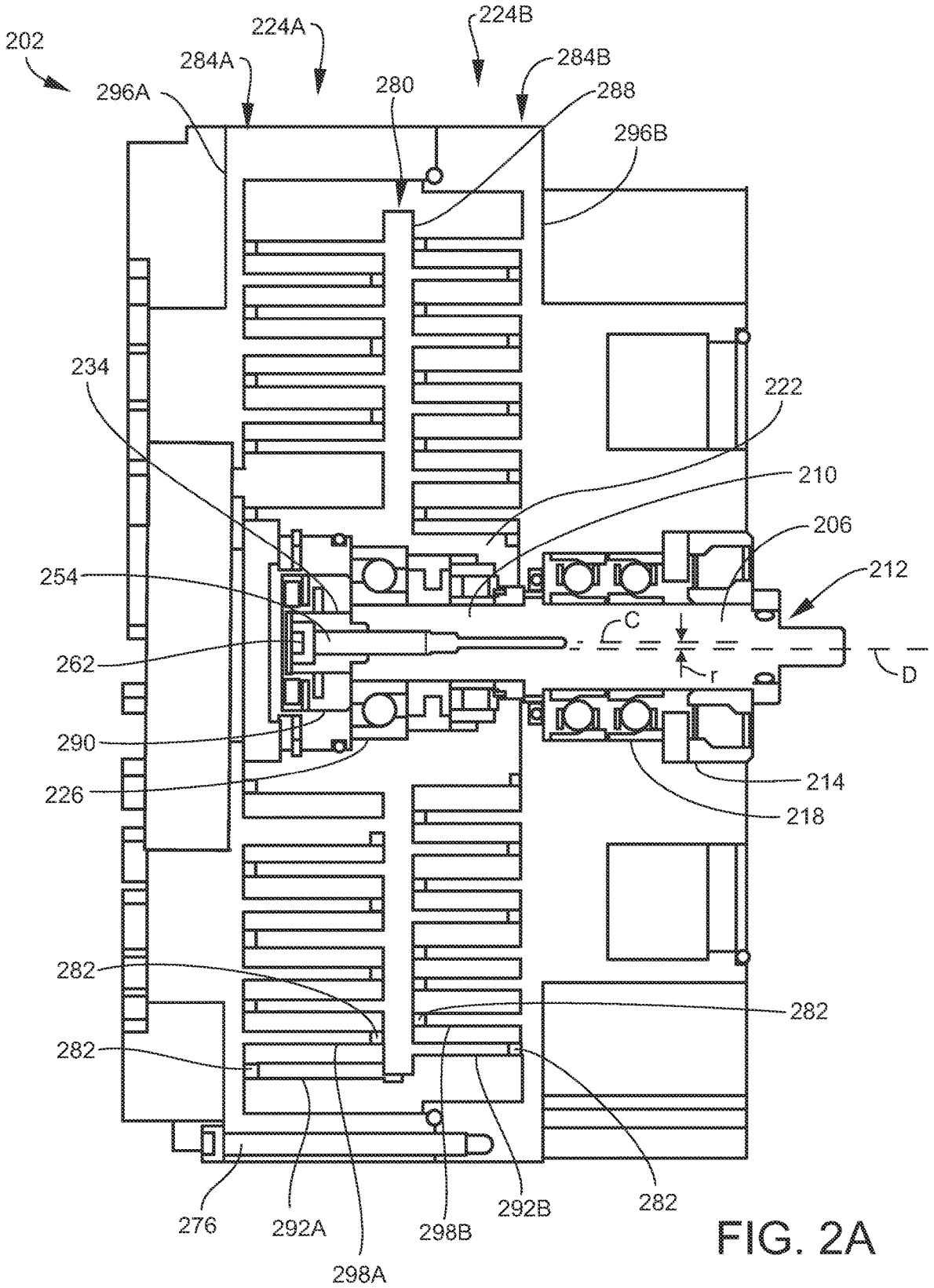
FIG. 2A is a cross-sectional elevation view of an example of a pump head for a scroll pump according to an implementation of the present disclosure.
Figure 2B:
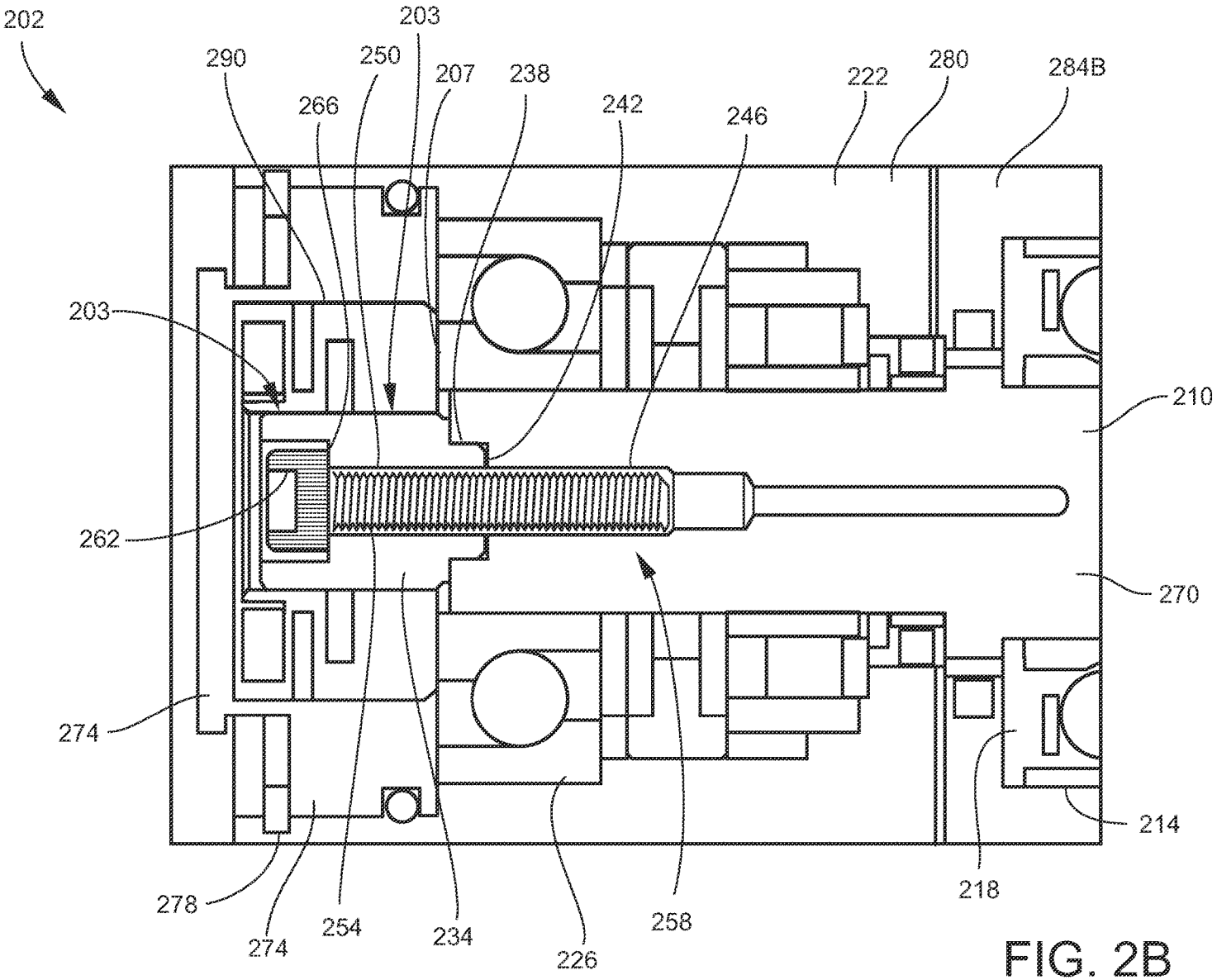
FIG. 2B is a close-up view of a region of the pump head illustrated in FIG. 2A.

FIG. 2A is a cross-sectional elevation view of an example of a pump head 202 according to an implementation of the present disclosure. The pump head 202 may be utilized, for example, as the pump head 102 of the scroll pump 100 described above and illustrated in FIG. 1. FIG. 2B is a close-up view of a region of the pump head 202 described below.

Generally, the pump head 202 may include a stationary pump frame and/or pump housing (not shown) that encloses and/or supports various components of the pump head 202. For example, various components of the pump head 202 may be integrated with or attached to a pump frame or housing. In the present implementation, the pump head 202 is a multi-stage pump head. Specifically, the pump head 202 is a two-stage pump head and thus includes a first (or outboard, or upstream) pumping stage 224A and a second (or inboard, or downstream) pumping stage 224B fluidly communicating in series (with respect to the fluid flow path F, FIG. 1) with the first pumping stage 224A. The first pumping stage 224A receives the (lower-pressure) working fluid from the pump inlet 128 (FIG. 1), (at least slightly) compresses the working fluid, and outputs the compressed working fluid to the second pumping stage 224B. The second pumping stage 224B further compresses the working fluid and discharges the (now even higher-pressure) working fluid to the pump outlet 136 (FIG. 1). As shown, the total internal volume and volumetric displacement rate of one pumping stage (e.g., first pumping stage 224A) may be different from those of the other pumping stage (e.g., second pumping stage 224B).

Alternatively, the pump head 202 may be configured such that the inboard pumping stage is the first pumping stage and the outboard pumping stage is the second pumping stage. Alternatively, the pump head 202 may provide more than two pumping stages and/or two or more pumping stages operating in parallel. As another alternative, the pump head 202 may be a single-stage pump head.

As a two-stage pump head, the pump head 202 includes an orbiting scroll 280 axially interposed between a fixed (stationary) outboard scroll 284A and a fixed (stationary) inboard scroll 284B. The fixed outboard scroll 284A and the outboard side of the orbiting scroll 280 cooperatively define the first pumping stage 224A, and the fixed inboard scroll 284B and the inboard side of the orbiting scroll 280 cooperatively define the second pumping stage 224B. During operation of the pump head 202, the orbiting scroll 280 eccentrically orbits in a circular path around the drive axis D at an offset or radial distance r (in the transverse plane orthogonal to the drive axis D) from the drive axis D, as described further below.

The orbiting scroll 280 includes an orbiting scroll plate 288 oriented in the transverse plane, at least one orbiting outboard (first) scroll blade 292A extending (or projecting) axially from the outboard side of the orbiting scroll plate 288 toward the fixed outboard scroll 284A, and at least one orbiting inboard (second) scroll blade 292B extending (or projecting) axially from the inboard side of the orbiting scroll plate 288 toward the fixed inboard scroll 284B. The fixed outboard scroll 284A includes a transversely-oriented fixed outboard scroll plate 296A and at least one fixed outboard scroll blade 298A extending (or projecting) axially toward the outboard side of the orbiting scroll plate 288. The fixed inboard scroll 284B includes a transversely-oriented fixed inboard scroll plate 296B and at least one fixed inboard scroll blade 298B extending (or projecting) axially toward the inboard side of the orbiting scroll plate 288.

The fixed inboard scroll 284B may be removably attached to or integral with the above-noted pump frame or housing. The fixed outboard scroll 284A may be removably attached to the fixed inboard scroll 284B (or alternatively to another stationary structure such as the pump frame 210) by an appropriate fastening device (e.g., a pattern of bolts or screws 276 as illustrated, etc.). The interface between the fixed outboard scroll 284A and the fixed inboard scroll 284B may be sealed against fluid leakage by an appropriate sealing element such as an O-ring, gasket, etc.

The orbiting outboard scroll blade 292A, the orbiting inboard scroll blade 292B, the fixed outboard scroll blade 298A, and the fixed inboard scroll blade 298B are each spiral-shaped (each runs along a spiral path, which may be Archimedean, involute, etc.) in the transverse plane. The cross-sectional view of FIG. 2A shows several (e.g., four) turns or revolutions taken by the scroll blades 292A, 292B, 298A and 298B, along their respective spiral paths. As shown, the orbiting outboard scroll blade 292A is juxtaposed with the fixed outboard scroll blade 298A in the radial direction (orthogonal to the drive axis D), such that the orbiting outboard scroll blade 292A and the fixed outboard scroll blade 298A are nested (or interleaved, interdigitated, intermeshed, etc.) together with a predetermined relative angular positioning. Likewise, the orbiting inboard scroll blade 292B is juxtaposed with the fixed inboard scroll blade 298B in the radial direction, such that the orbiting inboard scroll blade 292B and the fixed inboard scroll blade 298B are nested together with a predetermined relative angular positioning. By this configuration, as the orbiting scroll 280 orbits relative to the fixed outboard scroll 284A and the fixed inboard scroll 284B, one or more variable-volume pockets are defined in the first pumping stage 224A by (and between) the nested orbiting outboard scroll blade 292A and fixed outboard scroll blade 298A, and one or more variable-volume pockets are defined in the second pumping stage 224B by (and between) the nested orbiting inboard scroll blade 292B and fixed inboard scroll blade 298B.

Figure 3:
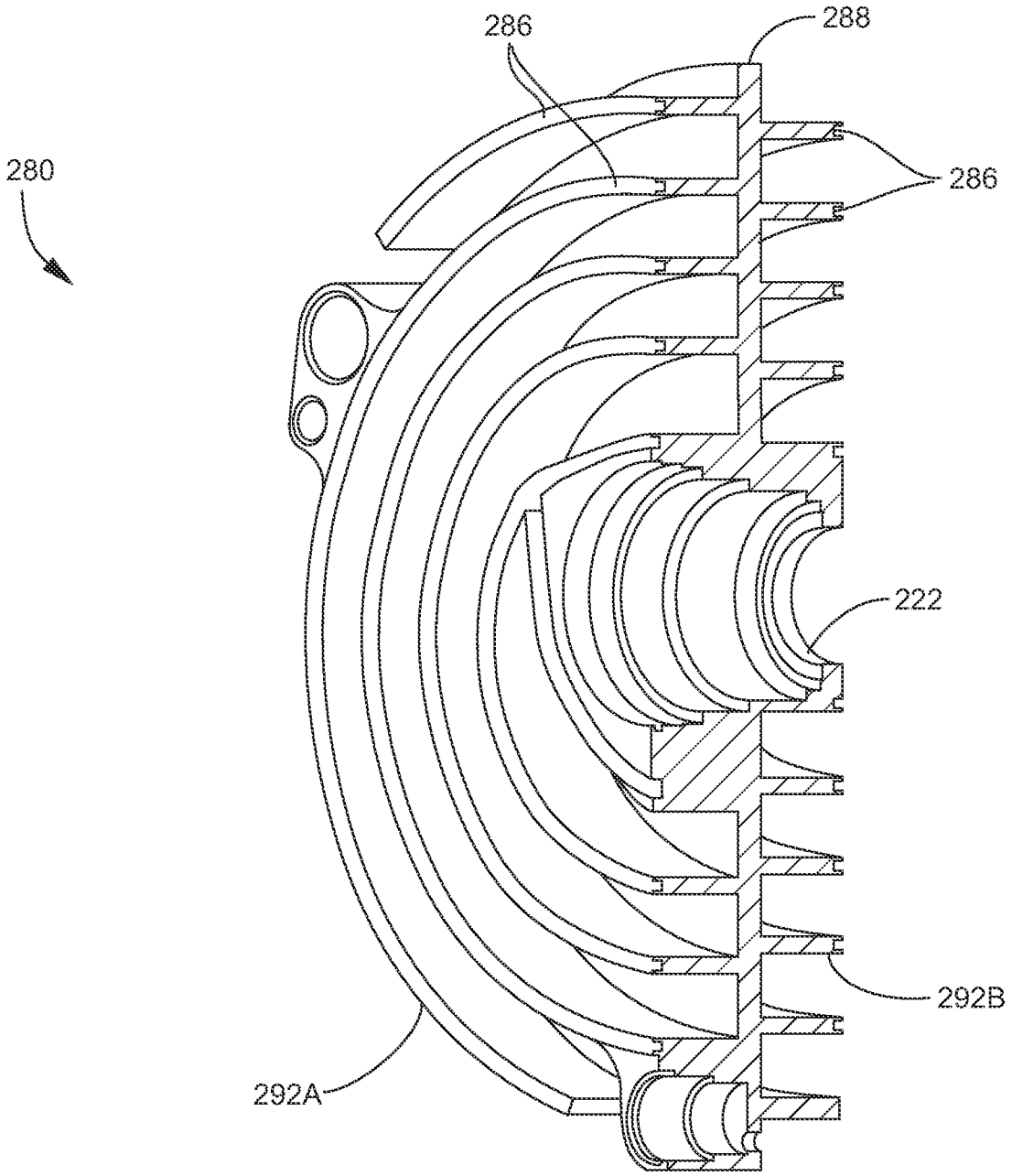
FIG. 3 is a cross-sectional perspective view of an orbiting scroll included with the pump head illustrated in FIG. 2A.

As an example, FIG. 3 is a cross-sectional perspective view of the orbiting scroll 280 in which about half of the orbiting scroll 280 is illustrated. FIG. 3 shows the multi-revolution, spiral shapes of the orbiting outboard scroll blade 292A and orbiting inboard scroll blade 292B. The spiral shapes of the fixed outboard scroll blade 298A and the fixed inboard scroll blade 298B may be similar.

Figure 4:
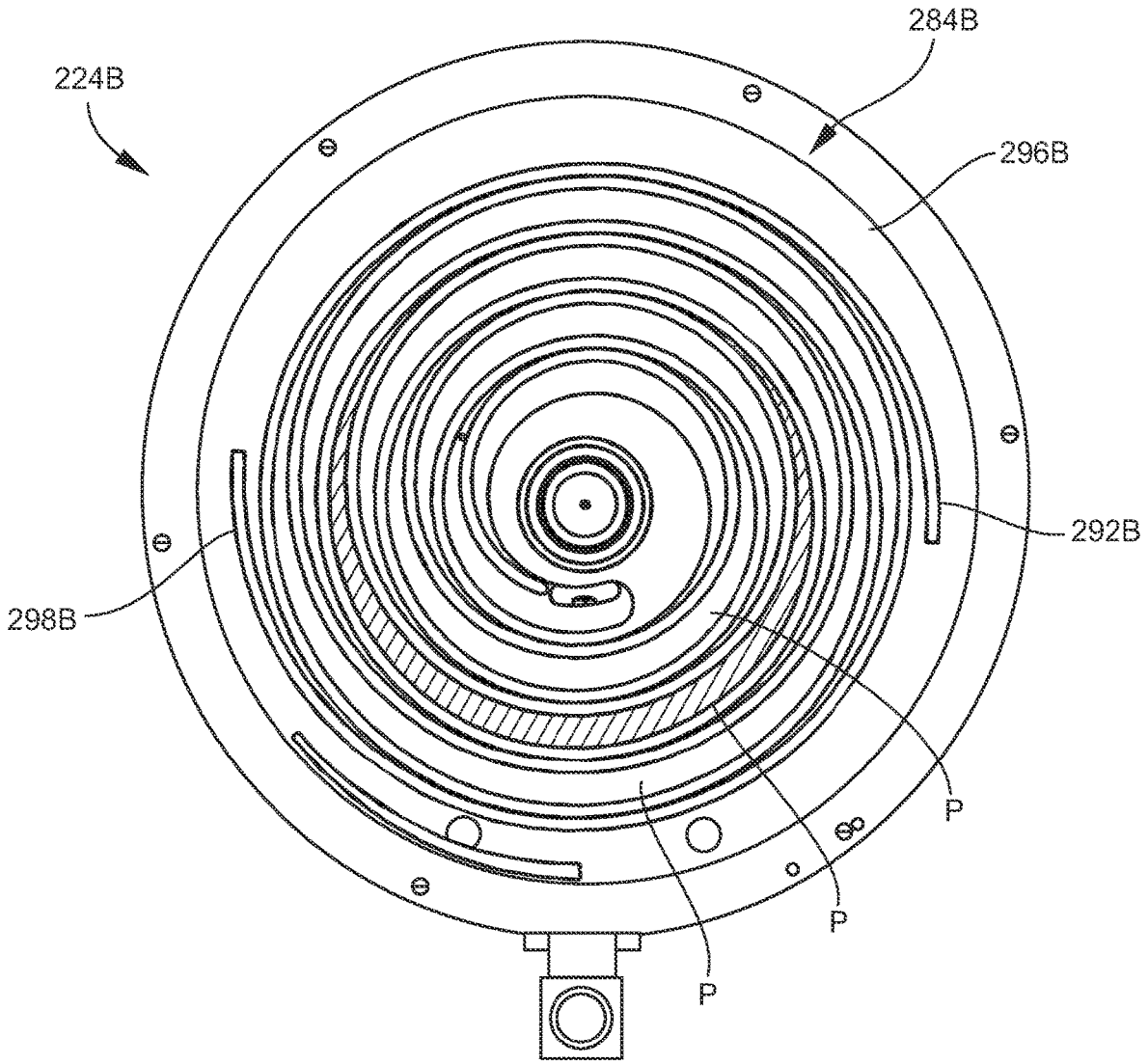
FIG. 4 is a cross-sectional plan view (in the transverse plane) of a pumping stage of the pump head illustrated in FIG. 2A.

As another example, FIG. 4 is a cross-sectional plan view (in the transverse plane) of the second pumping stage 224B. FIG. 4 illustrates the nested relation between the orbiting inboard scroll blade 292B and the fixed inboard scroll blade 298B, and the development of crescent-shaped, moving, variable-volume pockets P between adjacent sections of the orbiting inboard scroll blade 292B and the fixed inboard scroll blade 298B (see also FIG. 5). The second pumping stage 224B includes one or more pumping stage inlet ports located at or near the outer periphery, and one or more pumping stage outlet ports located at or near the center. Generally, the working fluid enters at least one inlet port, is compressed and displaced radially inwardly toward the center, and then is discharged from at least one outlet port. For example, as the orbiting inboard scroll blade 292B orbits, the trailing end of a given (or first) pocket P opens into fluid communication with an inlet port and takes in a quantity of the incoming working fluid. As the orbiting inboard scroll blade 292B continues to orbit, both the leading end and the trailing end of the pocket P may become substantially closed off, i.e., leaving only a small clearance between adjacent points of the orbiting inboard scroll blade 292B and the fixed inboard scroll blade 298B at the respective leading end and the trailing end. In addition, the volume of the pocket P decreases, thereby (at least slightly) compressing the working fluid trapped in the pocket P. As the orbiting inboard scroll blade 292B continues to orbit further, the leading end of the pocket P opens into fluid communication with an outlet port and the compressed working fluid is discharged from the pocket P and through the outlet port. One or more additional pockets P may operate in same manner at least partially simultaneously with the first pocket P.

In the present implementation, the first pumping stage 224A includes one or more pumping stage inlet ports located at or near the center, and one or more pumping stage outlet ports located at or near the outer periphery. In this configuration, the working fluid enters at least one inlet port, is compressed and displaced radially outwardly toward the outer periphery, and then is discharged from at least one outlet port. This pumping action is effected by moving pockets in a manner analogous to the second pumping stage 224B just described. The working fluid is then transferred to at least one inlet port of the second pumping stage 224B via an interconnecting fluid passage.

In some implementations, at least one of the pumping stages 224A or 224B includes more than one distinct pair of nested scroll blades. That is, the orbiting scroll 280 may include more than one distinct orbiting outboard scroll blade 292A and the fixed outboard scroll 284A may include more than one distinct fixed outboard scroll blade 298A. Alternatively or additionally, the orbiting scroll 280 may include more than one distinct orbiting inboard scroll blade 292B and the fixed inboard scroll 284B may include more than one distinct fixed inboard scroll blade 298B. An example of a pumping stage having three pairs of nested scroll blades is described in U.S. Pat. No. 5,855,473, the entire contents of which are incorporated by reference herein.

As shown in FIG. 2A, the pump head 202 includes a crankshaft 212, which may correspond to the crankshaft 112 described above and illustrated in FIG. 1. The crankshaft 212 includes a main shaft 206 (portion or section) and an eccentric shaft (portion or section) or crank 210 integral with or attached to the main shaft 206. The main shaft 206 extends in the outboard direction from the motor side (from right to left in FIG. 2A) into a central bore 214 of the fixed inboard scroll 284B. The main shaft 206 rotates directly on (coaxial or coincidently with) the drive axis D, which rotation is driven by the motor 104 (FIG. 1). One or more bearings 218 are configured to support the rotation of the main shaft 206 and/or bear thrust forces generated during operation. The crank 210 extends in the outboard direction from the main shaft 206 into the central (orbiting scroll) bore of an orbiting scroll hub 222 of the orbiting scroll 280. The central axis of the crank 210 (designated as crank axis C in FIG. 2A) is radially offset from the central axis of the main shaft 206 (drive axis D) by the above-noted radial distance r and thus orbits in a circular path of radius r around the drive axis D as the main shaft 206 rotates on the drive axis D. The orbiting scroll 280 is coupled to the crank 210 via one or more bearings 226 and thus orbits with the crank 210. The bearings 226 are configured to support the orbiting of the crank 210 and orbiting scroll 280 and/or bear thrust forces generated during operation. The scroll pump 100 may also include one or more counterweights (not shown) mounted to the crankshaft 212 and/or motor shaft 108 (FIG. 1) that are configured (sized, positioned, etc.) to balance the forces generated by the other orbiting components (e.g., orbiting scroll 280, crank 210, bearings 226), as appreciated by the skilled artisan.

The pump head 202 is configured to constrain the motion of the orbiting scroll 280 to the orbiting motion only. That is, the pump head 202 is configured to prevent the orbiting scroll 280 from rotating about its own central axis (i.e., the crank axis C). For this purpose, the scroll pump 100 may include an appropriate anti-rotation device (e.g., metal bellows, Oldham coupling, eccentrically positioned synchronization cranks or idler shafts, etc., not shown) interfaced with the orbiting scroll 280 as appreciated by persons skilled in the art.

As best shown in FIG. 2B, the pump head 202 further includes a stub shaft 234 removably attached (or fastened, mounted, etc.) to the outboard end of the crankshaft 212 (specifically, the outboard end of the crank 210). To facilitate a correctly aligned engagement between the stub shaft 234 and the crank 210, the engaging end of the stub shaft 234 may include an annular boss or protrusion 238 that fits into a complementarily shaped recess or counterbore 242 formed at the corresponding engaging (outboard) end of the crank 210. The stub shaft 234 may be attached to the crank 210 by utilizing an appropriate fastener or fasteners or by any other manner that is effective to maintain secure engagement between the stub shaft 234 and the crank 210 over repeated cycling of the operation of the pump head 202, particularly the operation of the orbiting scroll 280. In the present implementation, the crank 210 has a centrally located axial crank (first) bore 246 and the stub shaft 234 has a centrally located axial stub shaft (second) bore 250 aligned with the crank bore 246. To securely attach the stub shaft 234 to the crank 210, a stub shaft screw 254 is passed through the stub shaft bore 250 and threaded (screwed) into the crank bore 246. Thus, an outer thread of the stub shaft screw 254 mates with an inner thread of the crank bore 246 to form a threaded engagement 258 between the stub shaft screw 254 and the crank 210, whereby the stub shaft 234 is axially clamped between a screw head 262 of the stub shaft screw 254 and the crank 210. The screw head 262 may fit inside a recess or counterbore 266 of the stub shaft 234 that may function as a mechanical stop for limiting the extent of axial translation of the stub shaft screw 254 into the crank bore 246.

In another implementation, instead of utilizing the stub shaft screw 254, the stub shaft 234 and stub shaft bore 250 may be sized larger such that the stub shaft bore 250 is able to fit around the outside surface of the crank 210. In this case, the stub shaft bore 250 may have an inner thread and the outside surface of the crank 210 may have a complementary outer thread. Accordingly, in such implementation, the stub shaft 234 may be screwed onto, rather than into, the crank 210.

In other implementations, other types of stub shaft fasteners may be utilized to securely fasten the stub shaft 234 and the crank 210 together. Examples include, but are not limited to, clamping components, radially-oriented screws or pins, spring-biased balls or other engaging members, bayonet mechanisms, locking members, retainers (e.g., rings), magnets, etc., as appreciated by persons skilled in the art.

In an implementation, the stub shaft 234 may be considered as being a removable part of the crankshaft 212. In other words, the crankshaft 212 may be considered as being a multi-piece (multi-part) crankshaft. In the illustrated example, the crankshaft 212 may be considered as being at least a two-piece (two-part) crankshaft that includes the integrated main shaft 206 and crank 210 as one piece and the removable stub shaft 234 as the other piece.

In an implementation, the crank 210 may be considered as including a first crank section 270 (FIG. 2B) integrated with (or attached to) the main shaft 206 and a second crank section (the stub shaft 234) removably attached to the first crank section 270.

In the present implementation, the pump head 202 may further include an axial end cap or cover 274 (FIG. 2B) positioned at the outermost end (on the outboard side) of the stub shaft 234. The end cap 274 may be cup-shaped as illustrated. The end cap 274 may be removably mounted at least partially inside the orbiting scroll hub 222 and secured by an appropriate retainer 278 such as a snap ring, C-clip or the like that expands into an annular inside groove of the orbiting scroll hub 222. The end cap 274 may provide a closed end on the outboard side of the stub shaft 234 and may serve as a solid barrier to prevent the passage of fluids (e.g., working fluid, lubricant such as grease, etc.) and particulates (e.g., dust, dirt, metal fines, plastic fines, debris, etc.) in either direction through the end cap 274. The interface between the end cap 274 and the orbiting scroll hub 222 may be sealed against fluid and particulate leakage by an appropriate sealing element such as an O-ring, gasket, etc.

Figure 5:
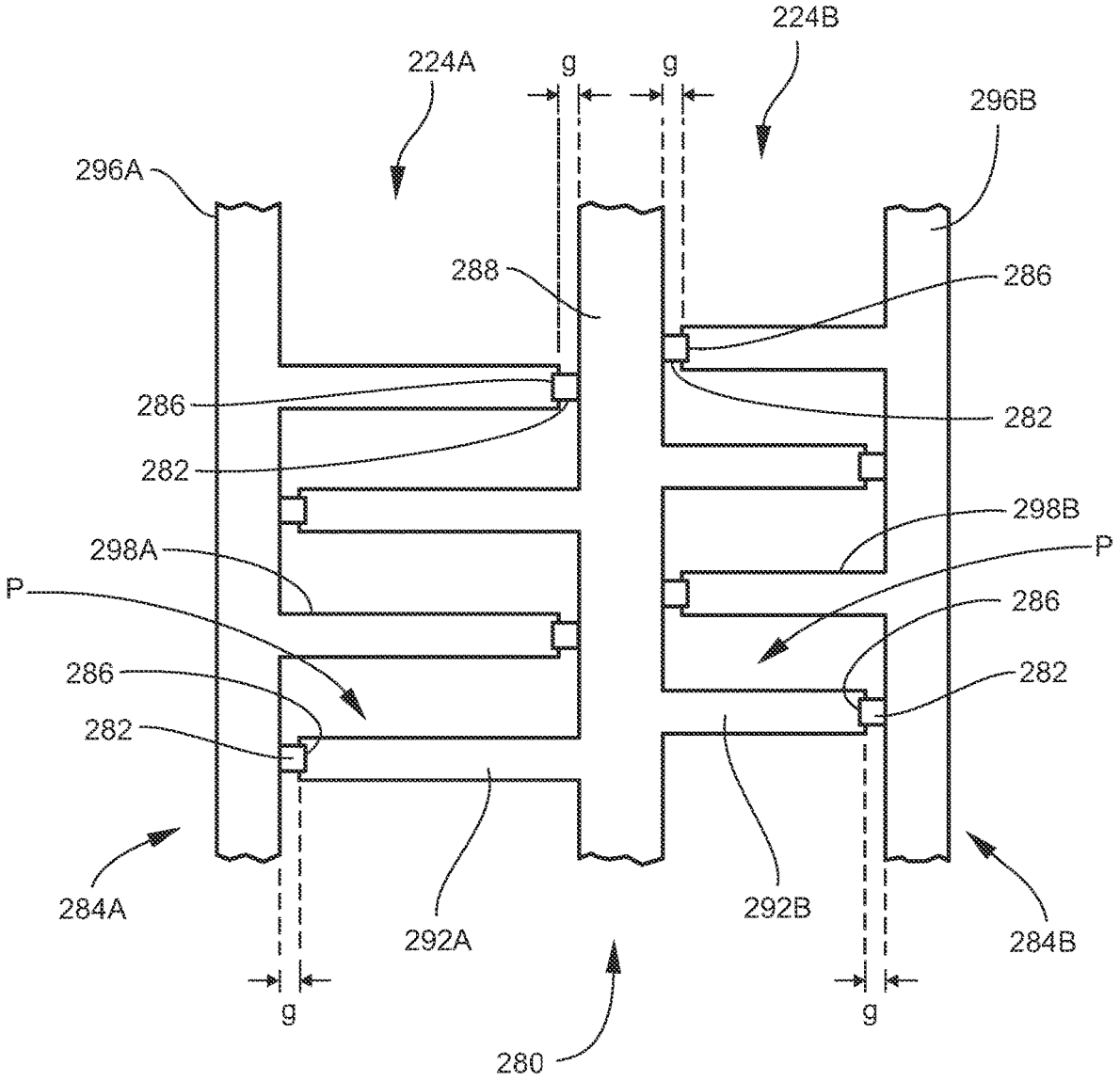
FIG. 5 is a close-up view of a region of two pumping stages of the pump head illustrated in FIG. 2A.

FIG. 5 is a close-up view of a region of the pumping stages 224A and 224B illustrated in FIG. 2A. As shown, small axial gaps g exist between the blade tips (free ends) of each scroll blade 292A, 292B, 298A and 298B and the surfaces of the scroll plates 288, 296A and 296B that are immediately adjacent to and facing those blade tips. Specifically, an axial gap g exists between the tip of the orbiting outboard scroll blade 292A and the fixed outboard scroll plate 296A, another axial gap g exists between the tip of the fixed outboard scroll blade 298A and the outboard side of the orbiting scroll plate 288, another axial gap g exists between the tip of the orbiting inboard scroll blade 292B and the fixed inboard scroll plate 296B, and an another axial gap g exists between the tip of the fixed inboard scroll blade 298B and the inboard side of the orbiting scroll plate 288. The axial gaps g create partially or substantially fluid-sealed interfaces that allow the development of the above-noted moving, variable-volume pockets P for trapping, compressing and transporting the working fluid without constraining the orbital motion of the orbiting scroll 280.

In the present implementation, the axial gaps g are at least partially occupied or filled by dynamic tip seals 282. The blade tip of each scroll blade 292A, 292B, 298A and 298B has a groove 286 (see also FIG. 3) in which a tip seal 282 is mounted, such that each groove 286 and corresponding tip seal 282 (orbiting outboard tip seal, orbiting inboard tip seal, fixed outboard tip seal, and fixed inboard tip seal) run along the same spiral path as its corresponding scroll blade 292A, 292B, 298A and 298B. The above-noted axial gap g may be specified as being the axial distance between the bottom of the groove 286 (instead of the blade tip) and the correspondingly adjacent scroll plate 288, 296A and 296B. As one example, the axial gap g may be on the order of a few (e.g., less than 10) thousandths of an inch (e.g., in a range from 0.001" to 0.002", or about 0.025 mm to about 0.051 mm). The tip seals 282 may each have a one-piece construction composed of an elastomeric polymer such as, for example, a natural or synthetic rubber (e.g., a closed-cell foam rubber). Alternatively, the tip seals 282 may each have a two-piece construction that includes an elastomeric (springy) layer resting on the bottom of the groove 286 and a wear-resistant layer (e.g., a polytetrafluoroethylene (PTFE) based material) disposed on the elastomeric layer and extending out from the groove 286.

The tip seals 282 may enhance the sealing interfaces between the orbiting scroll 280 and the fixed scrolls 284A and 284B. During operation of the pump head 202 and particularly during the orbital motion of the orbiting scroll 280, the tip seals 282 prevent direct contact between the blade tips of the scroll blades 292A, 292B, 298A and 298B and the correspondingly adjacent scroll plates 288, 296A and 296B. Due to exposure to friction and heat, the tip seals 282 eventually wear down with pump operation over time, which degrades the sealing effectiveness of the tip seals 282 and thus the pumping performance of the pumping stages 224A and 224B (e.g., the ability to generate and maintain vacuum). Thus, the tip seals 282 have a limited service life and periodically need to be replaced as part of a regular maintenance procedure.

The size (axial distances) of the axial gaps g affects the sealing effectiveness of the tip seals 282 and thus the pumping performance. The axial gap size depends on the axial position of the orbiting scroll 280 relative to the fixed scrolls 284A and 284B. In the case of a two-stage scroll pump as in the present implementation, it may be desirable to set the axial position of the orbiting scroll 280 so that the axial gap sizes on the outboard side are equal (or substantially equal) to the axial gap sizes on the inboard side of the orbiting scroll 280 or, alternatively, to set the axial position of the orbiting scroll 280 to set specific axial gap sizes on the respective outboard and inboard sides. In the latter case, the specific axial gap size on the outboard side may be equal to or different from the specific axial gap size on the inboard side depending on the requirements of the particular implementation. That is, shifting the axial position of the orbiting scroll 280 in the outboard direction decreases the axial gap sizes on the outboard side while increasing the axial gap sizes on the inboard side. Analogously, shifting the axial position of the orbiting scroll 280 in the inboard direction increases the axial gap sizes on the outboard side while decreasing the axial gap sizes on the inboard side.

In the present implementation, as best shown in FIG. 2B, the pump head 202 includes an adjusting nut 290 configured to control (adjust or set) the axial position of the orbiting scroll 280 and hence the axial gap size. The adjusting nut 290 is axially adjustable relative to the stub shaft 234. For this purpose, the adjusting nut 290 may be directly engaged with the stub shaft 234. For example, in the present implementation, the adjusting nut 290 is threaded (screwed) onto the stub shaft 234 such that the adjusting nut 290 is positioned axially between the end cap 274 and the outermost bearing 226 that is at least partially responsible for coupling the crank 210 and the orbiting scroll 280. In other words, inner threads of the adjusting nut 290 mate with an outer thread of the stub shaft 234 to form threaded engagements 203 between the adjusting nut 290 and the stub shaft 234. Thus, rotation of the adjusting nut 290 axially translates the adjusting nut 290 and thus adjusts its axial position along the length of the stub shaft 234. The threads may be fine-pitched to allow for very small, precise adjustments in the axial direction. In one specific example, the adjusting nut 290 may be (or have a configuration similar to) a locking nut commercially available from Spieth-Maschinenelemente GmbH & Co. KG, Esslingen, Germany.

The adjusting nut 290 is configured to contact a surface (e.g., inside the orbiting scroll hub 222) coupled to or integral with the orbiting scroll 280 such that axial adjustment of the adjusting nut 290 adjusts an axial position of the orbiting scroll 280 relative to the fixed scrolls 284A and 284B. In the present implementation, the adjusting nut 290 is mounted to the stub shaft 234 such that the adjusting nut 290 abuts an outermost face 207 (the outboard face) of the outermost bearing 226 that is coupled to the orbiting scroll 280, specifically the outboard face of the inner race of the outermost bearing 226. The inside diameter of the outermost bearing 226 is sized such that the outermost bearing 226 is slip-fitted on the crank 210, thereby allowing the outermost bearing 226 to be axially translated along the length of the crank 210 in response to an applied force. The outermost bearing 226 is preloaded with a spring-bias force imparted in the outboard direction (toward the adjusting nut 290) by one or more other components inside the orbiting scroll hub 222 (e.g., one or more spring washers, curved disk springs, wave washers, Belleville springs, etc.). By this configuration, after bringing the adjusting nut 290 into contact with the outermost face 207 of the outermost bearing 226, further rotation of the adjusting nut 290 in one direction will further axially translate the outermost bearing 226 in the inboard direction (to the right in FIGS. 2A and 2B) against the spring-bias force, and thus also axially translate the orbiting plate 280 (e.g., by sliding on the crank 210) in the inboard direction relative to the fixed scrolls 284A and 284B. On the other hand, rotation of the adjusting nut 290 in the opposite direction will cause axial translation of the outermost bearing 226 in the outboard direction (to the left in FIGS. 2A and 2B) due to the outboard-directed spring-bias force, and thus also the orbiting plate 280 in the outboard direction relative to the fixed scrolls 284A and 284B.

Figure 6:
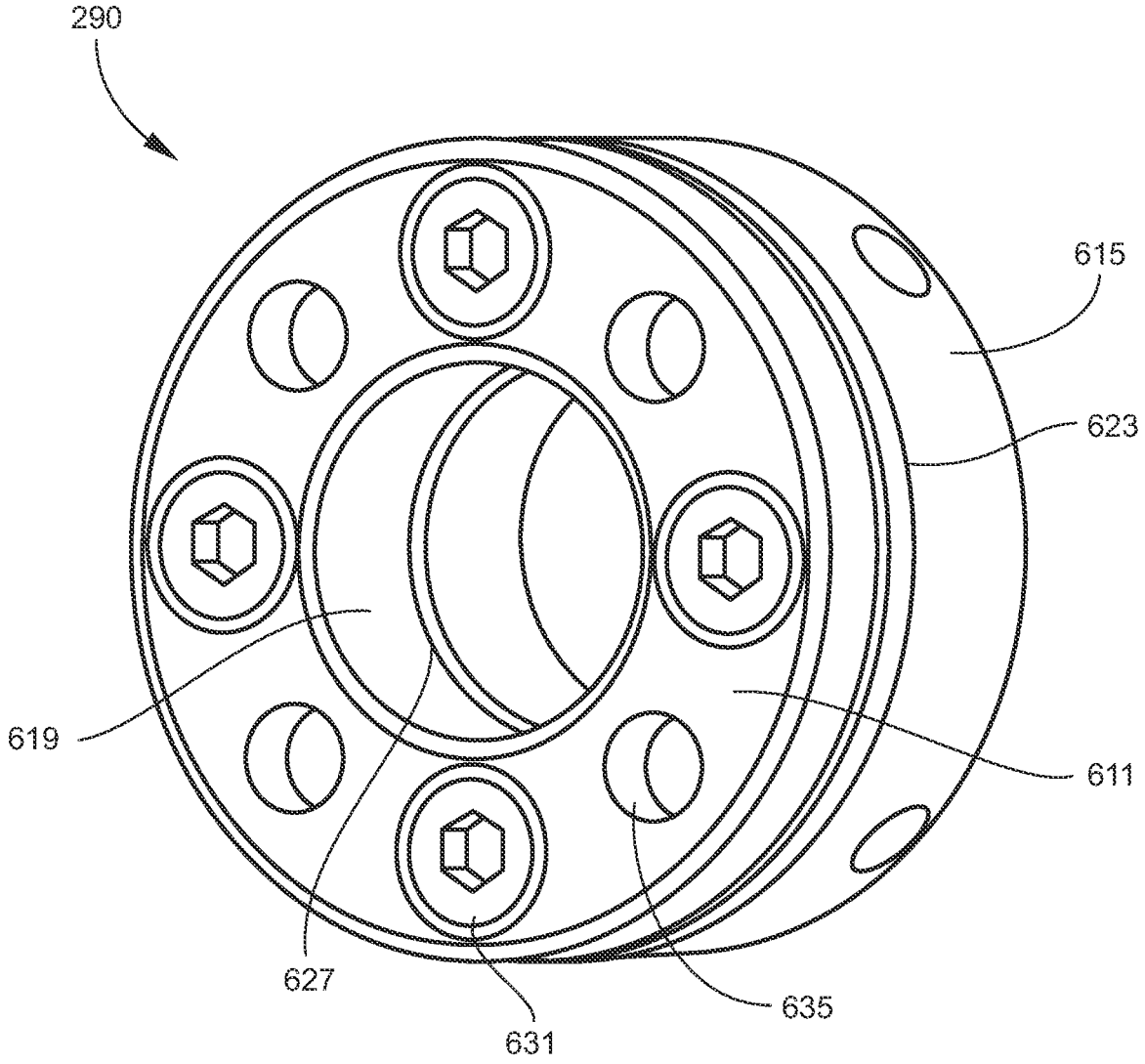
FIG. 6 is a perspective view of an example of an adjusting nut that may be included with the pump head illustrated in FIG. 2A.

Reference is additionally made to FIG. 6, which is a perspective view of an example of the adjusting nut 290. The adjusting nut 290 is primary defined by an annular body 611 that includes an annular outside surface 615 and an annular inside surface 619. An annular outside groove 623 is formed in the outside surface 615 and splits the outside surface 615 into two sections. An annular inside groove 627 is formed in the inside surface 619 and splits the inside surface 619 into two sections, each of which includes an inner thread with which the outer thread on the stub shaft 234 is configured to mate. Axially oriented locking screws 631 (e.g., four), equally spaced around a circumference of the annular body 611, are threaded into respective threaded holes formed in the annular body 611. Once the adjusting nut 290 has been translated to its chosen axial position on the stub shaft 234, the locking screws 631 are tightened to deform the annular outside groove 623 and the annular inside groove 627, thereby causing the annular body 611 to also deform and impart a gripping force to the stub shaft 234 (particularly to the outer thread of the stub shaft 234) to lock the adjusting nut 290 in place at the chosen axial position. The annular body 611 may also include a set of blind holes 635 configured to engage an appropriate tool that facilitates rotating (screwing) the adjusting nut 290 on the stub shaft 234.

The stub shaft 234 and its removability from the crank 210 may provide one or more advantages, particularly in comparison to scroll pumps of known configurations. For example, the stub shaft 234 may make easier the disassembly of the pump head 202 and resultant access to internal components of the pump head 202 such as the orbiting scroll 280, the fixed inboard scroll 284B, the tip seals 282, one or more bearings 226, etc. Due to the stub shaft 234, access to such internal components may require only a partial disassembly of the pump head 202 and less disassembly in comparison to previously known scroll pumps. Such internal components may then be serviced (e.g., cleaned, relubricated, repaired, etc.) or replaced as needed.

An example of partially disassembling the pump head 202 will now be described with reference being made primarily to FIGS. 2A and 2B. First, any components covering the outboard side of the pump head 202 (e.g., cowling 164 shown in FIG. 1, if provided, and any other covers, caps, etc.) are removed. Next, the fixed outboard scroll 284A is detached (e.g., unfastened) and removed from the fixed inboard scroll 284B (or from another stationary structure of the pump head 202, depending on the implementation). At this time or later, the tip seal 282 of the fixed outboard scroll 284A may be removed and replaced with a new tip seal if needed, and/or the fixed outboard scroll 284A may be otherwise serviced (e.g., cleaned, repaired, etc.) or replaced. For example, before mounting a new tip seal, the tip seal groove 286 of the fixed outboard scroll 284A may be cleaned. The stub shaft 234 is then accessed. In the present implementation, the stub shaft 234 is accessed by first removing the retainer 278 (by utilizing an appropriate tool, e.g., snap-ring pliers) and then removing the end cap 274. The O-ring of the end cap 274 may be replaced if needed. The stub shaft 234 may then be detached and removed from the crank 210 by unscrewing and removing the stub shaft screw 254 (or unfastening any other type of fastener provided). The orbiting scroll 280 is then removed, which is made easier by the provision of the removable stub shaft 234. Depending on the implementation, the outermost bearing 226 may need to be removed before removing the entire orbiting scroll 280. Depending on the implementation, a tool may or may not be needed to assist in removing the outermost bearing 226, or other bearings, or other annular components surrounding the crank 210. At this time or later, the outboard-side and inboard-side tip seals 282 of the orbiting scroll 280 may be removed and replaced with new tip seals if needed, and/or the orbiting scroll 280 may be otherwise serviced (e.g., cleaned, repaired, etc.) or replaced. For example, before mounting a new tip seal, the tip seal grooves 286 of the orbiting scroll 280 may be cleaned. In addition, any components located inside the orbiting scroll hub 222 and/or on or around the crank 210 (e.g., bearings 226, spacers, sleeves, washers, springs, shaft seals, etc.) may be serviced or replaced if needed.

In some implementations, the orbiting scroll 280 may have a multi-piece construction. In the present implementation, the removal of a multi-piece orbiting scroll from the crank 210 does not require the multi-piece orbiting scroll to be disassembled. Instead, the entire multi-piece orbiting scroll may be removed as a single-piece component.

The removal of the orbiting scroll 280 not only provides access to the inboard-side of the orbiting scroll 280, but also provides access to the fixed inboard scroll 284B from the outboard side of the pump head 202. The removal of the orbiting scroll 280 exposes the fixed inboard scroll 284B to the outboard side of the pump head 202. Hence, access to the fixed inboard scroll 284B does not require the fixed inboard scroll 284B to be detached and removed from the pump frame or housing, and such access also does not require the fixed inboard scroll 284B or any other any other component on the inboard side of the pump head 202 to be detached and/or removed from the crankshaft 212, shaft coupling 116 (FIG. 1), motor shaft 108, motor 104, or the like. With the orbiting scroll 280 removed, the tip seal 282 of the fixed inboard scroll 284B is then removed and replaced with a new tip seal, and the tip seal groove 286 of the fixed inboard scroll 284B may be cleaned, if needed. After maintenance is completed, reassembly of the pump head 202 may entail essentially the reverse of the foregoing steps of disassembly.

The stub shaft 234 and its removability from the crank 210 may be particularly useful when the pump head 202 includes the adjusting nut 290 described above. Advantageously, by the configuration of implementations disclosed herein, the stub shaft 234 may be reliably and repeatedly removed from and thereafter reattached to the crankshaft 212 (specifically the crank 210) in the same, exact axial position as before. In particular, the stub shaft 234 may be removed and precisely reattached without needing to move (rotate/translate) the adjusting nut 290 relative to the stub shaft 234 or to remove the adjusting nut 290 from the stub shaft 234. Consequently, the stub shaft 234 may be removed and reattached without needing to disturb the setting of the axial position of the adjusting nut 290. That is, the stub shaft 234 and the adjusting nut 290 may be removed and reinstalled together essentially as an integrated or single-piece component or assembly. In other words, the adjusting nut 290 remains locked in place on the stub shaft 234 during removal and reinstallation. This also means that internal components of the pump head 202 such as the orbiting scroll plate 280, tip seals 282, bearings 226, etc., may be removed and thereafter reinstalled or replaced without disturbing the setting of the adjusting nut 290. Thus, after reinstalling or replacing one or more internal components, reattachment of the stub shaft 234 to the crankshaft 212 automatically restores the preexisting (preset) axial position of the adjusting nut 290 and thus the preexisting axial position of the orbiting scroll 280 relative to the fixed scrolls 284A and 284B without needing to make any measurements or perform any advanced procedures. This configuration is particularly advantageous when, as is often the case, the preexisting axial position is the original axial position that was specified and set by the factory from which the pump head 202 or entire scroll pump 100 was obtained.

In other words, before removing the stub shaft 234 from the crank 210, the adjusting nut 290 is engaged with the stub shaft 234 at a preset (e.g., factory set) axial position on the stub shaft 234. Subsequently, the adjusting nut 290 and the stub shaft 234 are removable from the crank 210 together as an assembly without altering the preset axial position of the adjusting nut 290 on the stub shaft 234. Before removing the stub shaft 234 from the crank 210, the adjusting nut 290 may be located at a position that prevents removal of the orbiting scroll 280 from the crank 210. However, after removing the adjusting nut 290 and the stub shaft 234 together from the crank 210, the orbiting scroll 280 may then be removed from the crank 210.

Figure 7:
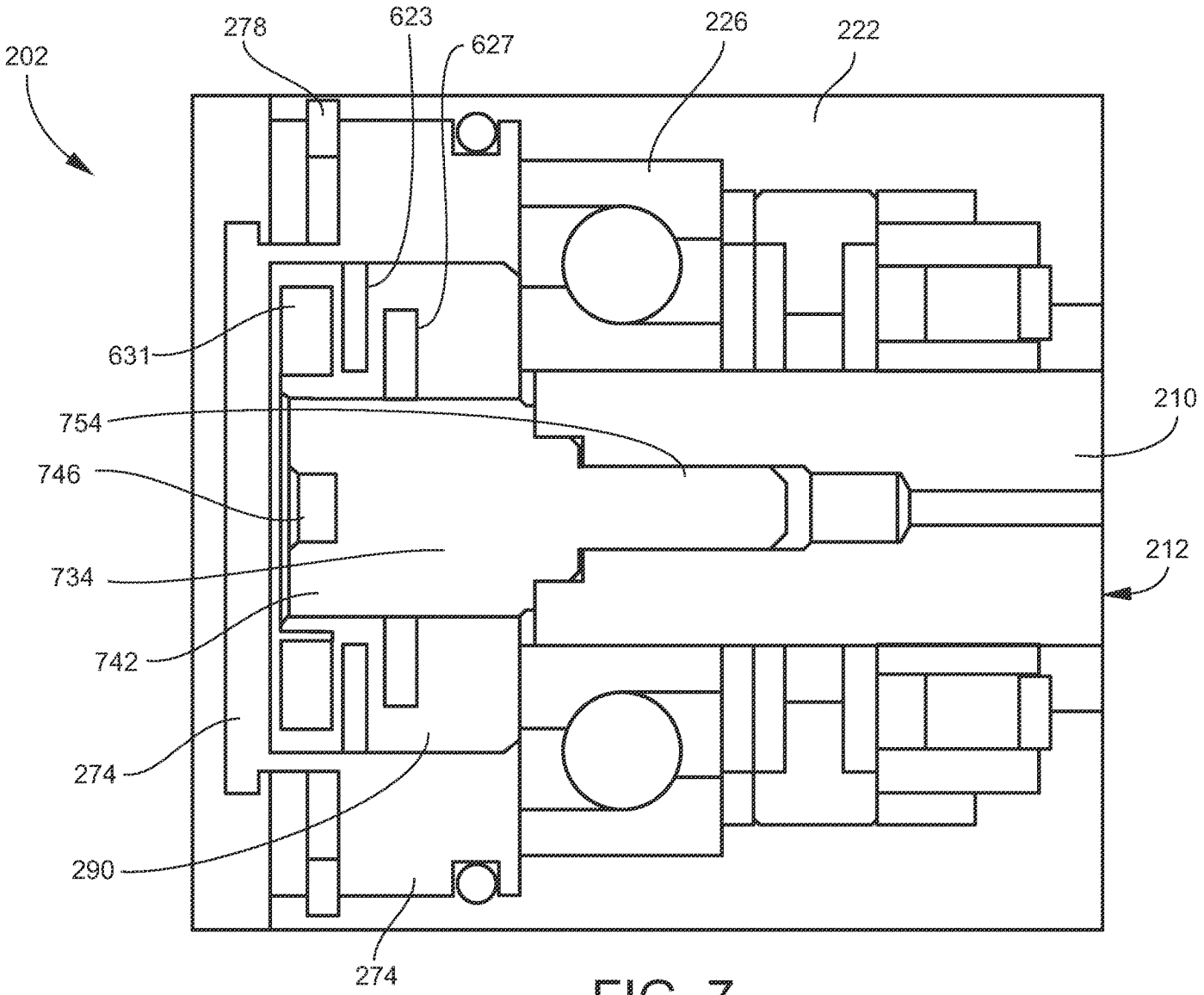
FIG. 7 is a cross-sectional elevation view of an example of a region of the pump head similar to FIG. 2B, according to another implementation of the present disclosure.

FIG. 7 is a cross-sectional elevation view of an example of a region of the pump head 202 similar to FIG. 2B, according to another implementation of the present disclosure. This implementation includes a stub shaft 734 with which the stub shaft screw (or other type of fastener) is integrated. The stub shaft 734 may include a head portion 742 and a threaded (screw) portion 754 with an outer thread (or may include another type of fastener portion). The head portion 742 may include a socket 746 configured to receive an appropriate tool (e.g., hex wrench) utilized to rotate the stub shaft 734 and thereby thread the stub shaft 734 into the crank 210.

Figure 8A:
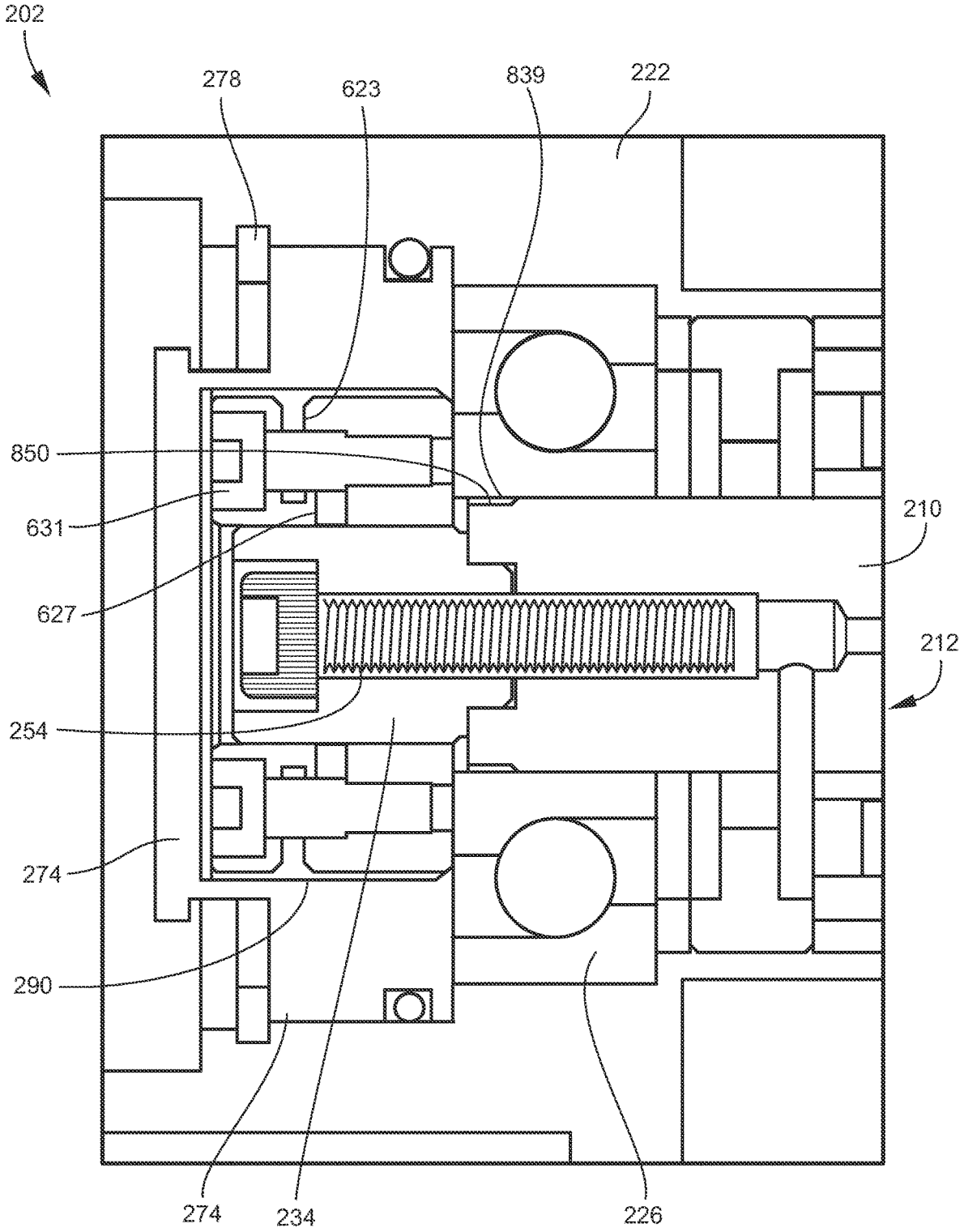
FIG. 8A is a cross-sectional elevation view of an example of a region of the pump head similar to FIG. 2B, according to another implementation of the present disclosure.

FIG. 8A is a cross-sectional elevation view of an example of a region of the pump head 202 similar to FIG. 2B, according to another implementation of the present disclosure. In this implementation, a circumferential relief 850 is formed or included around the outer surface of the crank 210 at the outboard end of the crank 210 where the stub shaft 234 is attached. The relief 850 constitutes a section of reduced outside diameter in comparison to the other, remaining portion of the crank 210. As one example, the outside diameter of the relief 850 may be in a range of 80% to 99%, or 95% to 99%, of the outside diameter of the remaining portion of the crank 210. As shown in FIG. 8A and other drawing figures, various types of annular members may surround the crank 210 in the interior of the orbiting scroll hub 222. One or more of these annular members may be mounted to the crank 210 as slip fits such that a radial gap is defined between the annular members and the crank 210. One or more of the annular members may directly surround the relief 850. In the present implementation, at least part of the inner race of the outermost bearing 226 directly surrounds the relief 850. Due to the reduced diameter of the relief 850, the radial gap between the relief 850 and the outermost bearing 226 is larger than the radial gap between the remaining portion of crank 210 (the rest of the crank 210) and other annular members. In other words, the radial gap includes an enlarged radial gap section 839 defined between the relief 850 and the annular member directly surrounding the relief 850 (the outermost bearing 226 in the present example), and the enlarged radial gap section 839 is larger than a remaining portion of the radial gap. In the present context, a portion of the inside surface of the orbiting scroll hub 222 may be considered to be an "annular member" if no other annular member is positioned radially between that portion of the inside surface and the crank 210.

Figure 8B:
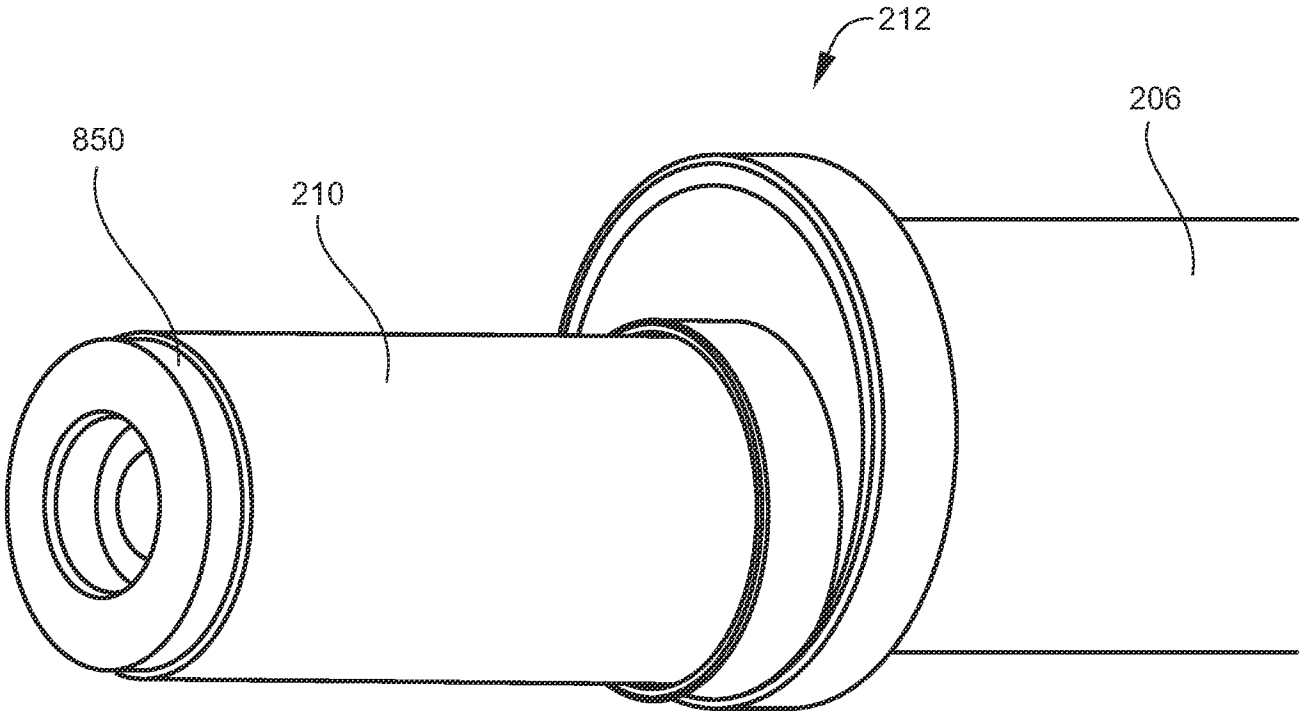
FIG. 8B is a perspective view of a crank end of a crankshaft included with the pump head illustrated in FIG. 8A.

FIG. 8B is a perspective view of the crank 210 that also shows the relief 850.

When the threaded joint between the stub shaft 234 and the crank 210 is tightened, the outside diameter of the crank 210 will expand in accordance with Poisson's ratio due to the compressive stress applied to the crank 210. In most cases, due to the close running clearance between the scrolls 280, 284A and 284B, a tight slip fit is established between the outer diameter of the crank 210 and the inner diameter of the orbiting scroll bearings 226 and other annular members. Consequently, this small expansion of the crank 210 due to tightening of the stub shaft screw 254 may cause the crank 210 to expand enough to make it difficult or even impossible to assemble the orbiting plate 280 to the crank 210. To compensate for this expansion, the relief 850 may be provided at the end of the crank 210 as illustrated to avoid an interference fit between the crank 210 and the orbiting scroll bearings 226 after tightening the stub shaft screw 254. The relief 850 also may be provided in any of the other implementations of the pump head 202 disclosed herein.

The implementations specifically illustrated in the drawing figures relate primarily to two-stage (or, more generally, a multi-stage) scroll pumps. However, the subject matter disclosed herein applies equally to single-stage scroll pumps. A single-stage scroll pump has a single pair of nested scrolls. For example, a single-stage scroll pump may have an orbiting scroll with a scroll blade on the outboard side only, which is nested with a single fixed scroll positioned on the outboard side of the orbiting scroll. Alternatively, a single-stage scroll pump may have an orbiting scroll with a scroll blade on the inboard side only, which is nested with a single fixed scroll positioned on the inboard side of the orbiting scroll. The present subject matter is particularly useful in the latter case, namely a single, inboard-positioned pumping stage. This is because, as described above, the present subject matter enables easy removal of the orbiting scroll from the outboard side of the pump head to thereby gain access to pump components positioned on the inboard side of the orbiting scroll.

As an example, a scroll pump such as disclosed herein may operate at a pumping speed in a range from 10 L/min to 1000 L/min, or from 50 L/min to 500 L/min. As an example, a scroll pump such as disclosed herein may generate an ultimate vacuum level in a range from $5\times10^{-1}$ mbar ($3.75\times10^{-1}$ Torr) down to $15\times10^{-3}$ mbar ($11.25\times10^{-1}$ Torr), or from $3\times10^{-1}$ ($2.25\times10^{-1}$ Torr) mbar down to $9\times10^{-3}$ mbar ($6.75\times10^{-1}$ Torr).

It will be understood that terms such as "communicate with" and "in . . . communication with" (for example, a first component "communicates with" or "is in communication with" a second component), as well as "coupled to" or "coupled with," are used herein to indicate a structural, functional, mechanical, electrical, signal, optical, magnetic, electromagnetic, ionic or fluidic relationship between two or more components or elements. As such, the fact that one component is said to communicate with or be coupled to/with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A scroll pump head, comprising:

a pumping stage comprising an orbiting scroll and a fixed scroll nested together, wherein the orbiting scroll is configured to orbit about a drive axis relative to the fixed scroll to create a moving pocket between the orbiting scroll and the fixed scroll effective to pump fluid from a pump inlet to a pump outlet;

a crankshaft comprising a main shaft rotatable about the drive axis and a crank radially offset from the drive axis and coupled to the orbiting scroll, wherein the crank is configured to drive the orbiting scroll to orbit around the drive axis in response to rotation of the main shaft, and the crank comprises an outboard end axially opposite the main shaft; and a stub shaft removably attached to the crank and extending axially away from the outboard end.

2. The scroll pump head of claim 1, wherein the orbiting scroll comprises an orbiting scroll bore, and the stub shaft is disposed in the orbiting scroll bore when removably attached to the crank.

3. The scroll pump head of claim 1, comprising a stub shaft fastener configured to removably attach the stub shaft to the crank.

4. The scroll pump head of claim 3 wherein the stub shaft fastener is separate from the stub shaft.

5. The scroll pump head of claim 3, wherein the stub shaft fastener is integral with the stub shaft.

6. The scroll pump head of claim 3, wherein the crank comprises a crank thread, and the stub shaft fastener comprises a stub shaft thread configured to engage the crank thread.

7. The scroll pump head of claim 3, wherein the crank comprises a crank axial bore with an inner thread, and the stub shaft fastener comprises a stub shaft screw with an outer thread configured to engage the inner thread.

8. The scroll pump head of claim 1, comprising a configuration according to one of:

wherein the crank comprises a crank end adjacent to the stub shaft and a relief disposed at the crank end, and the relief has an outside diameter that is reduced in comparison to an outside diameter of a remaining portion of the crank;

wherein the crank comprises a crank end adjacent to the stub shaft and a relief disposed at the crank end, the relief has an outside diameter that is reduced in comparison to an outside diameter of a remaining portion of the crank, the scroll pump head comprises an annular member surrounding the crank such that a radial gap is defined between the crank and the annular member, the radial gap comprises an enlarged radial gap section defined between the relief and the annular member, and the enlarged radial gap section is larger than a remaining portion of the radial gap.

9. The scroll pump head of claim 1, wherein:

the orbiting scroll has an outboard side and an inboard side, and along an axial direction relative to the drive axis, the outboard side is closer to an ambient external to the scroll pump head than the inboard side;

the fixed scroll is a fixed inboard scroll, the pumping stage is an inboard pumping stage comprising the fixed inboard scroll and the inboard side of the orbiting scroll, and the orbiting scroll and the fixed inboard scroll are nested together on the inboard side; and the outboard side blocks access to the inboard side and the fixed inboard scroll in a direction from the outboard side toward the inboard side.

10. The scroll pump head of claim 9, wherein the orbiting scroll comprises an orbiting inboard tip seal, the fixed inboard scroll comprises a fixed inboard tip seal, and the outboard side blocks access to the orbiting inboard tip seal and the fixed inboard tip seal in the direction from the outboard side toward the inboard side.

11. The scroll pump head of claim 9, comprising an outboard pumping stage, the outboard pumping stage comprising a fixed outboard scroll and the outboard side of the orbiting scroll, wherein:

the orbiting scroll and the fixed outboard scroll are nested together on the outboard side; and the orbiting scroll is configured to orbit about the drive axis relative to the fixed outboard scroll to create a moving pocket on the outboard side between the orbiting scroll and the fixed outboard scroll.

12. The scroll pump head of claim 11, wherein:

the orbiting scroll comprises an orbiting inboard tip seal and an orbiting outboard tip seal, the fixed inboard scroll comprises a fixed inboard tip seal, and the fixed outboard scroll comprises a fixed outboard tip seal; and the outboard side blocks access to the orbiting inboard tip seal and the fixed inboard tip seal in the direction from the outboard side toward the inboard side.

13. The scroll pump head of claim 1, comprising an adjusting nut axially adjustable relative to the stub shaft, wherein the adjusting nut is configured to contact a surface coupled to or integral with the orbiting scroll, and axial adjustment of the adjusting nut adjusts an axial position of the orbiting scroll relative to the fixed scroll.

14. The scroll pump head of claim 13, wherein the adjusting nut is engaged with the stub shaft at a preset axial position on the stub shaft, and the adjusting nut and the stub shaft are removable from and reinstallable to the crank together as an assembly without altering the preset axial position.

15. The scroll pump head of claim 14, wherein the adjusting nut comprises an adjusting nut thread, and the stub shaft comprises a stub shaft thread configured to engage the adjusting nut thread.

16. The scroll pump head of claim 14, wherein the adjusting nut is located at a position that prevents removal of the orbiting scroll from the crank.

17. A method for performing maintenance on a scroll pump head, the method comprising:

providing the scroll pump head, the scroll pump head comprising:

a pumping stage comprising an orbiting scroll and a fixed scroll nested together, wherein the orbiting scroll is configured to orbit about a drive axis relative to the fixed scroll to create a moving pocket between the orbiting scroll and the fixed scroll effective to pump fluid from a pump inlet to a pump outlet;

a crankshaft comprising a main shaft rotatable about the drive axis and a crank radially offset from the drive axis and coupled to the orbiting scroll, wherein the crank is configured to drive the orbiting scroll to orbit around the drive axis in response to rotation of the main shaft, and the crank comprises an outboard end axially opposite the main shaft; and a stub shaft removably attached to the crank and extending axially away from the outboard end;

removing the stub shaft from the crank; and removing the orbiting scroll from the crank.

18. The method of claim 17, comprising at least one of:

before the removing of the orbiting scroll, the orbiting scroll blocks access to an inboard component of the scroll pump head, and the method further comprises, after the removing of the orbiting scroll, servicing or replacing the inboard component;

the orbiting scroll comprises an orbiting tip seal and the fixed scroll comprises a fixed tip seal; before the removing of the orbiting scroll, the orbiting scroll blocks access to the orbiting tip seal and the fixed tip seal; and the method further comprises, after the removing of the orbiting scroll, replacing at least one of the orbiting tip seal or the fixed tip seal with a new tip seal.

19. The method of claim 17, comprising one of:

the scroll pump head comprises an adjusting nut axially adjustable relative to the stub shaft and, before the removing of the stub shaft, the adjusting nut is located at a preset axial position relative to the stub shaft;

the scroll pump head comprises an adjusting nut axially adjustable relative to the stub shaft and, before the removing of the stub shaft, the adjusting nut is located at a preset axial position relative to the stub shaft, wherein the removing of the stub shaft comprises removing the adjusting nut together with the stub shaft as an assembly without altering the preset axial position;

the scroll pump head comprises an adjusting nut axially adjustable relative to the stub shaft and, before the removing of the stub shaft, the adjusting nut is located at a preset axial position relative to the stub shaft, wherein the removing of the stub shaft comprises removing the adjusting nut together with the stub shaft as an assembly without altering the preset axial position; and the method further comprises, after the removing of the adjusting nut together with the stub shaft, reinstalling the adjusting nut together with the stub shaft by reattaching the stub shaft to the crank, wherein the preset axial position of the adjusting nut on the stub shaft determines an axial position of the orbiting scroll relative to the fixed scroll, and the reattaching restores the axial position of the orbiting scroll relative to the fixed scroll corresponding to the preset axial position.

20. A scroll pump head, comprising:

a pumping stage comprising an orbiting scroll and a fixed scroll nested together, wherein the orbiting scroll is configured to orbit about a drive axis relative to the fixed scroll to create a moving pocket between the orbiting scroll and the fixed scroll effective to pump fluid from a pump inlet to a pump outlet;

a crankshaft comprising a main shaft rotatable about the drive axis and a crank radially offset from the drive axis and coupled to the orbiting scroll, wherein the crank is configured to drive the orbiting scroll to orbit around the drive axis in response to rotation of the main shaft; and a stub shaft removably attached to the crank and configured to engage an adjusting nut and allow the adjusting nut to be axially adjustable relative to the stub shaft.

* * * * *